US009418786B2

(12) United States Patent
Nishiuchi et al.

(10) Patent No.: US 9,418,786 B2
(45) Date of Patent: Aug. 16, 2016

(54) R—FE—B POROUS MAGNET AND METHOD FOR PRODUCING THE SAME

(75) Inventors: Takeshi Nishiuchi, Osaka (JP); Noriyuki Nozawa, Osaka (JP); Satoshi Hirosawa, Osaka (JP); Tomohito Maki, Osaka (JP); Katsunori Bekki, Osaka (JP)

(73) Assignee: HITACHI METALS, LTD., Tokyo (JP)

( * ) Notice: Subject to any disclaimer, the term of this patent is extended or adjusted under 35 U.S.C. 154(b) by 472 days.

(21) Appl. No.: 13/586,917

(22) Filed: Aug. 16, 2012

(65) Prior Publication Data

US 2012/0306308 A1 Dec. 6, 2012

Related U.S. Application Data

(62) Division of application No. 12/092,300, filed as application No. PCT/JP2007/060216 on May 18, 2007, now Pat. No. 8,268,093.

(30) Foreign Application Priority Data

| | | |
|---|---|---|
| May 18, 2006 | (JP) | 2006-139148 |
| Jun. 30, 2006 | (JP) | 2006-181944 |
| Aug. 18, 2006 | (JP) | 2006-223162 |
| Sep. 5, 2006 | (JP) | 2006-240306 |
| Nov. 30, 2006 | (JP) | 2006-324298 |

(51) Int. Cl.
*H01F 1/057* (2006.01)
*H01F 41/02* (2006.01)

(52) U.S. Cl.
CPC ..... *H01F 41/028* (2013.01); *H01F 1/057* (2013.01); *H01F 1/0573* (2013.01); *H01F 1/0576* (2013.01); *H01F 1/0578* (2013.01); *H01F 1/0579* (2013.01); *Y10T 428/12153* (2015.01)

(58) Field of Classification Search
CPC ..... H01F 1/057
USPC ..... 148/122, 302; 419/6
See application file for complete search history.

(56) References Cited

U.S. PATENT DOCUMENTS 4,981,532 A * 1/1991 Takeshita et al. ..... 148/302

OTHER PUBLICATIONS

Nishiuchi et al.; "R—Fe—B Porous Magnet and Method for Producing the Same", U.S. Appl. No. 12/092,300; filed May 1, 2008.

* cited by examiner

*Primary Examiner* — Brian Walck
(74) *Attorney, Agent, or Firm* — Keating & Bennett, LLP

(57) ABSTRACT

An R—Fe—B based porous magnet according to the present invention has an aggregate structure of $Nd_2Fe_{14}B$ type crystalline phases with an average grain size of 0.1 μm to 1 μm. At least a portion of the magnet is porous and has micropores with a major axis of 1 μm to 20 μm.

9 Claims, 10 Drawing Sheets

(a)

(b)

(c)

R—FE—B POROUS MAGNET AND METHOD FOR PRODUCING THE SAME

TECHNICAL FIELD

The present invention relates to an R—Fe—B based porous magnet produced by an HDDR process and a method for producing such a magnet.

BACKGROUND ART

An R—Fe—B based rare-earth magnet (where R is a rare-earth element, Fe is iron, and B is boron) is a typical high-performance permanent magnet, has a structure including, as a main phase, an $R_2Fe_{14}B$ phase, which is a ternary tetragonal compound, and exhibits excellent magnet performance. Such R—Fe—B based rare-earth magnets are roughly classifiable into sintered magnets and bonded magnets. A sintered magnet is produced by compacting a fine powder of an R—Fe—B based magnet alloy (with a mean particle size of several Jim) with a press machine and then sintering the resultant compact. On the other hand, a bonded magnet is produced by compression-molding or injection-molding a mixture (i.e., a compound) of a powder of an R—Fe—B based magnet alloy (with particle sizes of about 100 μm) and a binder resin.

The sintered magnet is made of a powder with relatively small particle sizes, and therefore, the respective powder particles thereof exhibit magnetic anisotropy. For that reason, an aligning magnetic field is applied to the powder being compacted by the press machine, thereby making a powder compact in which the powder particles are aligned with the direction of the magnetic field.

The powder compact obtained in this manner is then sintered normally at a temperature of 1,000° C. to 1,200° C. and then thermally treated if necessary to be a permanent magnet. In the sintering process, the atmosphere is often a vacuum atmosphere or an inert atmosphere to reduce the oxidation of the rare-earth element.

To make the bonded magnet exhibit magnetic anisotropy on the other hand, the hard magnetic phases in the powder particles used should have their easy magnetization axes aligned in one direction. Also, to achieve coercivity to a practically required level, the crystal grain size of the hard magnetic phases that form the powder particles should be reduced to around the single domain critical size. For these reasons, to produce a good anisotropic bonded magnet, a rare-earth alloy powder that satisfies all of these conditions needs to be obtained.

To make a rare-earth alloy powder for an anisotropic bonded magnet, an HDDR (hydrogenation-disproportionation-desorption-recombination) process is generally adopted. The "HDDR" means a process in which hydrogenation, disproportionation, desorption and recombination are carried out in this order. In the known HDDR process, an ingot or powder of an R—Fe—B based alloy is maintained at a temperature of 500° C. to 1,000° C. within an $H_2$ gas atmosphere or a mixture of an $H_2$ gas and an inert gas so as to occlude hydrogen into the ingot or the powder. After that, the desorption process is carried out at the temperature of 500° C. to 1,000° C. until either a vacuum atmosphere with an $H_2$ pressure of 13 Pa or less or an inert atmosphere with an $H_2$ partial pressure of 13 Pa is created and then a cooling process is carried out.

In this process, the reactions typically advance in the following manner. Specifically, as a result of a heat treatment process for producing the hydrogen occlusion, the hydrogenation and recombination reactions (which are collectively referred to as "HD reactions" that may be represented by the chemical reaction formula: $Nd_2Fe_{14}B+2H_2 \rightarrow 2NdH_2+12Fe+Fe_2B$) advance to form a fine structure. Thereafter, by carrying out another heat treatment process to produce the desorption, the desorption and disproportionation reactions (which are collectively referred to as "DR reactions" that may be represented by the chemical reaction formula: $2NdH_2+12Fe+Fe_2B \rightarrow Nd_2Fe_{14}B+2H_2$) are produced to make an alloy with very fine $R_2Fe_{14}B$ crystalline phases.

An R—Fe—B based alloy powder, produced by such an HDDR process, exhibits high coercivity and has magnetic anisotropy. The alloy powder has such properties because the metallurgical structure thereof substantially becomes an aggregate structure of crystals with very small sizes of 0.1 μm to 1 μm. Also, if the reaction conditions and composition are selected appropriately, the easy magnetization axes of the crystals will be aligned in one direction, too. More specifically, the high coercivity is achieved because the grain sizes of the very small crystals, obtained by the HDDR process, are close to the single domain critical size of a tetragonal $R_2Fe_{14}B$ based compound. The aggregate structure of those very small crystals of the tetragonal $R_2Fe_{14}B$ based compound will be referred to herein as a "recrystallized texture". Methods of making an R—Fe—B based alloy powder having the recrystallized texture by the HDDR process are disclosed in Patent Documents Nos. 1 and 2, for example.

A magnetic powder made by the HDDR process (which will be referred to herein as an "HDDR powder") is normally mixed with a binder resin (which is also simply referred to as a "binder") to make a compound, which is then either compression-molded or injection-molded under a magnetic field, thereby producing an anisotropic bonded magnet. The HDDR powder will usually aggregate after the HDDR process. Thus, to use the powder to make an anisotropic bonded magnet, the aggregate structure is broken down into the powder again. For example, according to Patent Document No. 1, the magnet powder obtained preferably has a particle size of 2 μm to 50 μm. In Example #1 of that document, an aggregate structure obtained by subjecting a powder with a mean particle size of 3.8 μm to the HDDR process is crushed in a mortar to obtain a powder with a mean particle size of 5.8 μm. Thereafter, the powder is mixed with a bismaleimide triazine resin and then the compound is compression-molded to make a bonded magnet.

On the other hand, a technique for aligning an HDDR powder and then turning the powder into a bulk by a hot compaction process such as a hot pressing process or a hot isostatic pressing (HIP) process was proposed in Patent Document No. 3, for example. By adopting a hot compaction process, the density of the powder can be increased at low temperatures. As a result, a bulk magnet can be produced with the recrystallized texture of the HDDR powder maintained.

Various other methods for producing an R—Fe—B based permanent magnet by taking advantage of features of the HDDR process have also been proposed. For example, according to the method disclosed in Patent Document No. 4, an R—Fe—B based alloy that has been prepared by melting materials in an induction melting furnace is subjected to a solution treatment, if necessary, cooled, and then pulverized into a coarse powder. The powder is further pulverized finely to a size of 1 μm to 10 μm using a jet mill, for example, and then compacted under a magnetic field. Thereafter, the green compact is sintered at a temperature of 1,000° C. to 1,140° C. within either a high vacuum or an inert atmosphere. Then, the sintered compact is kept heated to a temperature of 600° C. to 1,100° C. within a hydrogen atmosphere and then thermally treated within a high vacuum, thereby reducing the size of the main phase to 0.01 μm to 1 μm.

On the other hand, according to the method disclosed in Patent Document No. 5, first, a fine powder with a particle size of less than 10 μm, obtained by pulverizing an alloy that has been subjected to a homogenization process with a pulverizer such as a jet mill, is compacted under a magnetic field to obtain a powder compact. Then, the powder compact is treated at a temperature of 600° C. to 1,000° C. within hydrogen and then at a temperature of 1,000° C. to 1,150° C. This series of processes carried out on the powder compact corresponds to the HDDR process. In this case, however, the temperature of the DR process is higher than that of the HD process. According to the method disclosed in Patent Document No. 5, sintering process is advanced by the DR process at the higher temperature, and therefore, the powder compact can be sintered as densely as it has been. Patent Document No. 5 says that the sintering process should be carried out at a temperature of at least 1,000° C. to make a sintered body with high density.

Furthermore, according to the method disclosed in Patent Document No. 6, first, the alloy is coarsely pulverized to a mean particle size of 50 μm to 500 μm by a hydrogen occlusion decrepitation process. Thereafter, the coarse powder is compacted into a predetermined shape (under a magnetic field, if necessary) to obtain a powder compact. Then, the powder compact is subjected to the known HDDR process. And the resultant powder compact is dipped or immersed in a resin, thereby producing a bonded magnet.

According to the methods disclosed in Patent Documents Nos. 5 and 6, the powder compact is subjected to the HDDR process in both cases. However, according to the method of Patent Document No. 5, the mechanical strength is increased by increasing the density through a high-temperature sintering process. On the other hand, according to the method disclosed in Patent Document No. 6, the mechanical strength is increased by using a resin.

Patent Document No. 1: Japanese Patent Application Laid-Open Publication No. 1-132106

Patent Document No. 2: Japanese Patent Application Laid-Open Publication No. 2-4901

Patent Document No. 3: Japanese Patent Application Laid-Open Publication No. 4-253304

Patent Document No. 4: Japanese Patent Application Laid-Open Publication No. 4-165012

Patent Document No. 5: Japanese Patent Application Laid-Open Publication No. 6-112027

Patent Document No. 6: Japanese Patent Application Laid-Open Publication No. 9-148163

DISCLOSURE OF INVENTION

Problems to be Solved by the Invention

An R—Fe—B based rare-earth sintered magnet realizes better magnetic properties than a bonded magnet but its formable shapes are limited. This is partly because it is difficult to form it in a desired shape due to the anisotropy of shrinkage during the sintering process. More specifically, the rate of shrinkage parallel to the aligning magnetic field is greater than the rate perpendicular to the aligning magnetic field by as much as twice or more. In this case, the "rate of shrinkage" is defined herein to be calculated by ("size of compact yet to be sintered"−"size of sintered compact")÷"size of compact yet to be sintered". In this description, the direction that is parallel to the aligning magnetic field will be referred to herein as an "aligning direction" and the direction that is perpendicular to the "aligning direction" will be referred to herein as a "die pressing direction".

Meanwhile, an R—Fe—B based bonded magnet has lower magnetic properties than a sintered magnet but can be formed in a desired shape relatively easily even if it would be difficult to form a sintered magnet in such a shape. Among other things, an anisotropic bonded magnet, made of an anisotropic magnetic powder, achieves relatively good magnetic properties and is expected to be applicable to motors, for example. An R—Fe—B based anisotropic magnetic powder can be obtained by the HDDR process. The anisotropic magnetic powder obtained by the HDDR process (which will be simply referred to herein as a "HDDR magnetic powder") has a mean particle size of several tens of μm to several hundreds of μm, mixed with a binder resin and then the compound is compacted. However, the HDDR magnetic powder cracks easily under the pressure applied during the compaction process. As a result, the magnetic properties deteriorate. Consequently, a bonded magnet produced by a conventional process has a $(BH)_{max}$ that is only about 60% of the magnetic powder used.

On top of that, the conventional R—Fe—B based anisotropic bonded magnet also has bad loop squareness in its demagnetization curve (which is the second quadrant of a hysteresis curve), which is factor of a decrease in thermal stability. That is why unless the coercivity $H_{cJ}$ of the R—Fe—B based anisotropic bonded magnet were higher than that of an R—Fe—B based sintered magnet, high thermal resistance could not be achieved. Meanwhile, if the coercivity $H_{cJ}$ were increased, then the magnetization property would deteriorate to restrict the design of a magnetic circuit.

According to the manufacturing process in which the HDDR powder is aligned under a magnetic field and then turned into a bulk by a hot compaction process such as hot pressing as disclosed in Patent Document No. 3, the shape of the resultant magnet is determined by that of the die. That is why the problem of shrinkage anisotropy, which often arises in a sintered magnet, rarely occurs essentially. However, since the hot compaction process achieves very poor productivity, the manufacturing cost would increase and it would be difficult to mass-produce such magnets at a cost that is low enough to make general-purpose motors.

According to the manufacturing process disclosed in Patent Document No. 4, the size of the main phase is reduced by subjecting the sintered body to the HDDR process. In the HDDR process, however, the volume varies during the HD reaction or the DR reaction. For that reason, when subjected to the HDDR process, the sintered body easily cracks and cannot be produced at a high yield. Also, since a bulk body (sintered body) that has already had its density increased is subjected to the HDDR process, hydrogen, which is an essential element for the HD reaction, will have its diffusion path limited. As a result, the homogeneity of the texture would decrease in the resultant magnet or it would take a lot of time to get the process done. Consequently, the size of the magnet that can be made would be restricted.

According to Patent Document No. 5, the bonded magnet should achieve better magnetic properties than a normal R—Fe—B based sintered magnet. However, the bonded magnet is also sintered at a temperature of 1,000° C. or more, which is as high as the sintering temperature of a normal sintered magnet, and therefore, its shrinkage would be anisotropic noticeably. As a result, the bonded magnet can also be formed in only limited shapes, which is essentially the same problem as a normal sintered magnet's. Furthermore, the present inventors discovered and confirmed via experiments that when a sintering process was carried out at 1,000° C. or more in the DR process, it was difficult to increase the density while keeping the crystal grains size so small but abnormal grain growth occurred noticeably. As a result, the magnetic properties eventually deteriorated more than a normal sintered magnet.

The method of Patent Document No. 6 is noteworthy in that this method makes it possible to avoid various problems (including deterioration in magnetic properties to be caused by pulverizing a magnetic powder during a compaction process and difficulty to align the magnetic powder as intended) of the conventional manufacturing process of an R—Fe—B based anisotropic bonded magnet. However, the powder compact obtained by this method through the HDDR process has strength that is barely high enough to avoid collapse, and therefore, it is difficult to handle such a powder compact after the HDDR process. In addition, the mechanical strength of the powder compact that has gone through the HDDR process must be increased with a binder resin.

In order to overcome the problems described above, the present invention has an object of providing, first and foremost, an R—Fe—B based magnet that has better magnetic properties than conventional bonded magnets and that can be shaped more flexibly than conventional sintered magnets.

Means for Solving the Problems

An R—Fe—B based porous magnet according to the present invention has an aggregate structure of $Nd_2Fe_{14}B$ type crystalline phases with an average grain size of 0.1 μm to 1 μm. At least a portion of the magnet is porous and has micropores with a major axis of 1 μm to 20 μm.

In one preferred embodiment, the magnet has a structure in which a plurality of powder particles, each having the aggregate structure of the $Nd_2Fe_{14}B$ type crystalline phases, have been bonded together and gaps between the powder particles define the micropores.

In this particular preferred embodiment, the powder particles have a mean particle size that is less than 10 μm.

In another preferred embodiment, the micropores communicate with the air.

In still another preferred embodiment, the micropores are filled with no resin.

In yet another preferred embodiment, the easy magnetization axes of the $Nd_2Fe_{14}B$ type crystalline phases are aligned in a predetermined direction.

In this particular preferred embodiment, the magnet has either radial anisotropy or polar anisotropy.

In yet another preferred embodiment, the magnet has a density of 3.5 g/cm$^3$ to 7.0 g/cm$^3$.

In yet another preferred embodiment, the magnet includes a rare-earth element, boron and/or carbon that satisfy 10 at %≤R≤30 at % and 3 at %≤Q≤15 at %, where R is the mole fraction of the rare-earth element and Q is the mole fraction of boron and carbon.

An R—Fe—B based magnet according to the present invention is characterized in that the density of an R—Fe—B based porous magnet according to a preferred embodiment of the present invention described above has been increased to as high as 95% or more of its true density.

In one preferred embodiment, in the aggregate structure of the $Nd_2Fe_{14}B$ type crystalline phases, crystal grains with b/a ratios that are less than two account for at least 50 vol % of all crystal grains, where a and b are the smallest and largest sizes of each of those crystal grains.

A method for producing an R—Fe—B based porous magnet according to the present invention includes the steps of: providing an R—Fe—B based rare-earth alloy powder with a mean particle size that is less than 10 μm; making a powder compact by compacting the R—Fe—B based rare-earth alloy powder; producing hydrogenation and disproportionation reactions by heat-treating the powder compact at a temperature of 650° C. to less than 1,000° C. within a hydrogen gas; and producing desorption and recombination reactions by heat-treating the powder compact at a temperature of 650° C. to less than 1,000° C. within either a vacuum or an inert atmosphere.

In one preferred embodiment, the step of making a powder compact includes compacting the rare-earth alloy powder under a magnetic field.

In another preferred embodiment, the R—Fe—B based rare-earth alloy powder has a composition that satisfies 10 at %≤R≤30 at % and 3 at %≤Q≤15 at %, where R is a rare-earth element and Q is either boron alone or the sum of boron and carbon that substitutes for a portion of boron.

In still another preferred embodiment, the mole fraction of the rare-earth element R is defined and the concentration of oxygen after the pulverization process step has been started and until the hydrogenation and disproportionation reactions are triggered is controlled such that the content of an extra rare-earth element R' satisfies R'≥0 at % when an HD process is started on the R—Fe—B based porous magnet.

In yet another preferred embodiment, the R—Fe—B based rare-earth alloy powder is obtained by pulverizing a rapidly solidified alloy.

In a specific preferred embodiment, the rapidly solidified alloy is a strip cast alloy.

In yet another preferred embodiment, the step of producing hydrogenation and disproportionation reactions includes increasing the temperature within either an inert atmosphere or a vacuum and supplying a hydrogen gas at a temperature of 650° C. to less than 1,000° C.

In yet another preferred embodiment, the hydrogen gas a partial pressure of 5 kPa to 100 kPa.

A method of making a composite bulk material to produce an R—Fe—B based permanent magnet according to the present invention includes the steps of: (A) providing an R—Fe—B based porous material according to a preferred embodiment of the present invention described above; and (B) introducing a different material, other than the R—Fe—B based porous material, into the micropores of the R—Fe—B based porous material by a wet process.

In one preferred embodiment, the step (A) includes: providing an R—Fe—B based rare-earth alloy powder with a mean particle size that is less than 10 μm; making a powder compact by compacting the R—Fe—B based rare-earth alloy powder; producing hydrogenation and disproportionation reactions and making an R—Fe—B based porous material by heat-treating the powder compact at a temperature of 650° C. to less than 1,000° C. within a hydrogen gas; and producing desorption and recombination reactions by heat-treating the powder compact at a temperature of 650° C. to less than 1,000° C. within either a vacuum or an inert atmosphere.

A method for producing an R—Fe—B based permanent magnet according to the present invention includes the steps of: preparing a composite bulk material to produce an R—Fe—B based permanent magnet by a method according to a preferred embodiment of the present invention described above; and further heating the composite bulk material to produce an R—Fe—B based permanent magnet, thereby forming an R—Fe—B based permanent magnet.

Another method of making a composite bulk material to produce an R—Fe—B based permanent magnet according to the present invention includes the steps of: (A) providing an R—Fe—B based porous material having an aggregate structure of $Nd_2Fe_{14}B$ type crystalline phases with an average grain size of 0.1 μm to 1 μm, at least a portion of the material having micropores with an average major axis of 1 μm to 20 μm; and (B) introducing at least one of rare-earth metals, rare-earth alloys and rare-earth compounds onto the surface and/or into the micropores of the R—Fe—B based porous material.

In one preferred embodiment, the step (B) includes introducing at least one of the rare-earth metals, the rare-earth alloys and the rare-earth compounds onto the surface and/or into the micropores of the R—Fe—B based porous material while heating the R—Fe—B based porous material at the same time.

In another preferred embodiment, the method further includes the step (C) of heating the R—Fe—B based porous material after the step (B) has been performed.

In still another preferred embodiment, the step (A) includes: providing an R—Fe—B based rare-earth alloy powder with a mean particle size that is less than 10 μm; making a powder compact by compacting the R—Fe—B based rare-earth alloy powder; producing hydrogenation and disproportionation reactions and making an R—Fe—B based porous material by heat-treating the powder compact at a temperature of 650° C. to less than 1,000° C. within a hydrogen gas; and producing desorption and recombination reactions by heat-treating the powder compact at a temperature of 650° C. to less than 1,000° C. within either a vacuum or an inert atmosphere.

Another method for producing an R—Fe—B based magnet according to the present invention includes the step of pressurizing an R—Fe—B based porous magnet according to a preferred embodiment of the present invention described above at a temperature of 600° C. to less than 900° C., thereby increasing the density of the R—Fe—B based porous magnet to as high as 95% or more of its true density.

A method of making an R—Fe—B based magnet powder according to the present invention includes the steps of: making a powder compact by compacting an R—Fe—B based rare-earth alloy powder with a mean particle size that is less than 10 μm; producing hydrogenation and disproportionation reactions by heat-treating the powder compact at a temperature of 650° C. to less than 1,000° C. within a hydrogen gas; producing desorption and recombination reactions and forming an R—Fe—B based porous magnet by heat-treating the powder compact at a temperature of 650° C. to less than 1,000° C. within either a vacuum or an inert atmosphere; and pulverizing the R—Fe—B based porous magnet.

A method for producing a bonded magnet according to the present invention includes the steps of: preparing an R—Fe—B based magnet powder by a method according to a preferred embodiment of the present invention described above; and mixing the R—Fe—B based magnet powder and a binder together and then compacting the mixture.

A magnetic circuit component making method according to the present invention is a method of making a magnetic circuit component in which rare-earth magnet compacts and a compact of a soft magnetic material powder are assembled together. The method includes the steps of: (a) providing a plurality of R—Fe—B based porous magnets as the rare-earth magnet compacts, each having an aggregate structure of $Nd_2Fe_{14}B$ type crystalline phases with an average grain size of 0.1 μm to 1 μm, at least a portion of the magnet having micropores with a major axis of 1 μm to 20 μm; and (b) subjecting the porous magnets and the soft magnetic material powder or a green compact of the soft magnetic material powder to a hot press compaction process, thereby obtaining a formed product in which the rare-earth magnet compacts and the compact of the soft magnetic material have been assembled together.

In one preferred embodiment, the step of providing R—Fe—B based porous magnets includes: providing an R—Fe—B based rare-earth alloy powder with a mean particle size that is less than 10 μm; making a powder compact by compacting the R—Fe—B based rare-earth alloy powder; producing hydrogenation and disproportionation reactions by heat-treating the powder compact at a temperature of 650° C. to less than 1,000° C. within a hydrogen gas; and producing desorption and recombination reactions by heat-treating the powder compact at a temperature of 650° C. to less than 1,000° C. within either a vacuum or an inert atmosphere.

In another preferred embodiment, the step (b) further includes the step (c) of making a green compact of the soft magnetic material powder by pressing and compacting the soft magnetic material powder. The step (b) includes obtaining a formed product in which the rare-earth magnet compacts and the compact of the soft magnetic material have been assembled together by subjecting the green compact of the soft magnetic material powder and the porous magnets to a hot press compaction process simultaneously.

In still another preferred embodiment, in the step (b), the soft magnetic material powder in a powder state is subjected to the hot press compaction along with the porous magnets.

A magnetic circuit component according to the present invention is made by a method according to a preferred embodiment of the present invention described above.

In one preferred embodiment, the magnetic circuit component is a magnet rotor.

Effects of the Invention

According to the present invention, with the mean particle size of an R—Fe—B based rare-earth alloy powder to be subjected to an HDDR process limited to less than 10 μm, a powder compact of such a powder is made and then subjected to the HDDR process. Since the powder particles have a relatively small size, the consistency of the HDDR reactions can be increased and the mechanical strength of the powder compact that has gone through the HDDR process can also be sufficiently high. According to the present invention, the HDDR powder compact has a sufficiently high strength for a porous magnet and can be used as a bulk magnet body as it is. That is why there is no need to pulverize or crush the HDDR powder compact and its properties as a magnet never deteriorate. As a result, a magnet with better magnetic properties than a conventional bonded magnet can be provided.

In addition, when a porous magnet is made out of the powder compact by the HDDR process, the powder compact shrinks isotropically. As a result, the magnet can be shaped more flexibly than a conventional sintered magnet, which is beneficial, too.

DESCRIPTION OF REFERENCE NUMERALS

Figure 1:
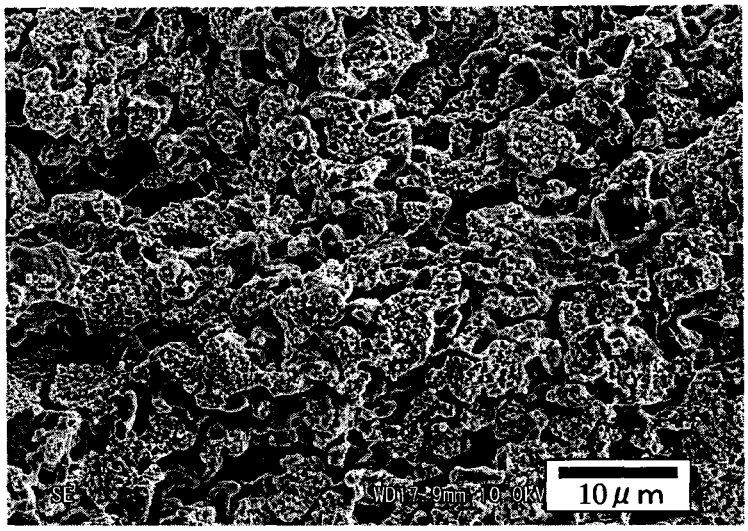
FIG. 1 is an SEM photograph showing a fractured face of a porous magnet representing a specific example of the present invention.

12*a*', 12*b*' R—Fe—B based porous magnet
12*a*, 12*b* magnet compact (magnet part)
22' green compact of soft magnetic material powder (green compact to be iron core)
22 compact of soft magnetic material powder (soft magnetic part, iron core)
26 chamber
27 die
28*a* upper punch
28*b* lower punch
32 die
42*a*, 42*b* lower punch
42*c* center shaft
44*a*, 44*b* upper punch
52 lower ram
54 upper ram

BEST MODE FOR CARRYING OUT THE INVENTION

The conventional HDDR process is carried out to make a magnet powder to produce a bonded magnet and is performed on a powder with a relatively large mean particle size. This is because if the mean particle size were decreased, it would be difficult to break down the powder that has aggregated through the HDDR process into separate powder particles. Meanwhile, as already described for the background art, it has also been proposed that the HDDR process be performed on a powder compact. However, the powder compact that has gone through the HDDR process has lower bond strength between particles than a normal sintered magnet, and is too brittle to handle as it is. Thus, it was virtually impossible to use such a powder compact that has gone through the HDDR process as a bulk magnet body.

To increase the mechanical strength of such a powder compact that has gone through the HDDR process, the present inventors dared to reduce the size of powder particles without taking the approach of increasing the HDDR process temperature as adopted in Patent Document No. 5. As a result, the present inventors discovered that a porous magnet with a sufficiently high mechanical strength could be obtained by setting the mean particle size of the powder particles and the HDDR process temperature appropriately, thus perfecting our invention.

An R—Fe—B based porous magnet according to the present invention has an aggregate structure of $Nd_2Fe_{14}B$ type crystalline phases with an average grain size of 0.1 μm to 1 μm. At least a portion of the magnet is porous and has micropores with a major axis of 1 μm to 20 μm. It should be noted that not all of the "porous magnet" of the present invention has to be porous. As used herein, the "porous portion" refers to a portion where an aggregate structure and pores are present. More specifically, the "porous portion" is a portion in which the aggregate structure of $Nd_2Fe_{14}B$ type crystalline phases with an average grain size of 0.1 μm to 1 μm and the pores with a major axis of 1 μm to 20 μm are present. Such a porous portion accounts for at least 20 vol % of the entire magnet, preferably 30 vol % or more of the magnet, and even more preferably 50 vol % or more of the magnet.

It should be noted that the "average grain size" refers herein to the average size of very small crystal grains that form the aggregate structure produced by the HDDR process. The average grain size of 0.1 μm to 1 μm is smaller than that of an R—Fe—B based sintered magnet (that is greater than 1 μm) but is greater than that of a quenched magnet produced by a rapid quenching process (that is less than 0.1 μm). Also, as used herein, the "major axis" refers to the length of the longest one of lines, each of which connects two arbitrary points on a profile of a micropore region of the porous portion described above. If the entire magnet consists of porous portions, then the major axis of micropores needs to be measured for only an arbitrary portion (e.g., a center portion) of the magnet. On the other hand, if part of the magnet is amorphous, the major axis of micropores needs to be measured on a region that has been selected from the porous portions.

FIG. 1 is an SEM photograph showing a fractured face of an R—Fe—B based porous magnet representing a specific example of the present invention to be described in detail later. As can be seen from FIG. 1, the micropores in this porous magnet are gaps between powder particles that have been bonded together through an HDDR process and communicate with each other to form a three-dimensional net. More specifically, the respective powder particles that formed a powder compact are bonded with adjacent powder particles through the HDDR process to form a three-dimensional structure with rigidity. Also, in each of those powder particles, formed is an aggregate structure of very fine $Nd_2Fe_{14}B$ type crystalline phases. Furthermore, the micropores are not filled with a resin but communicate with the air.

In the specific example shown in FIG. 1, the easy magnetization axis of the very fine $Nd_2Fe_{14}B$ type crystalline phases is aligned in a predetermined direction. By aligning the easy magnetization axis of powder particles yet to be subjected to the HDDR process in the predetermined direction, those very fine $Nd_2Fe_{14}B$ type crystalline phases in the aggregate structure produced by the HDDR process can also have their easy magnetization axis aligned in the predetermined direction in the entire magnet.

The R—Fe—B based porous magnet of the present invention has a density of 3.5 g/cm$^3$ to 7.0 g/cm$^3$, which is represented by the volume percentage of the magnetic powder and which is equal to or lower than that of a conventional R—Fe—B based bonded magnet produced by a compression-molding process. However, even when there are gaps between the powder particles, the powder particles are still bonded together and exhibit sufficiently high mechanical strength and good enough magnetic properties.

Figure 2:
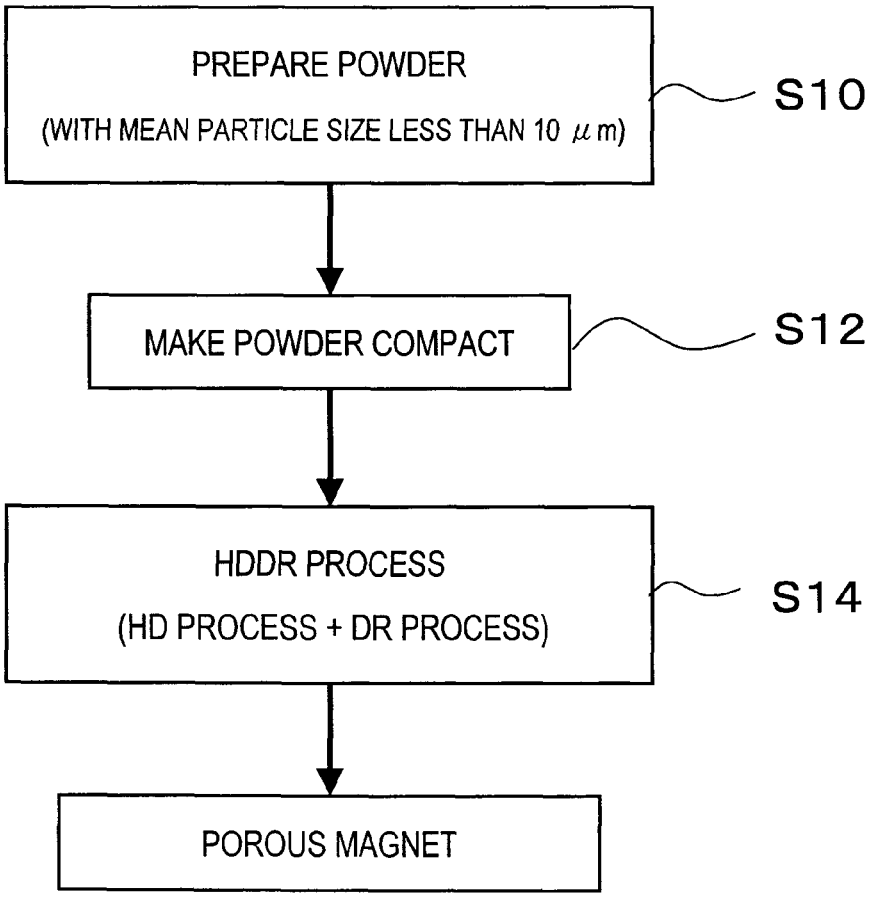
FIG. 2 is a flowchart showing a process for producing a porous magnet according to the present invention.

As shown in FIG. 2, the R—Fe—B based porous magnet of the present invention is produced by performing the process step S10 of preparing an R—Fe—B based rare-earth alloy powder with a mean particle size that is less than 10 μm by pulverizing a material alloy including an R—Fe—B phase, the process step S12 of making a powder compact (i.e., a green compact) by compressing the powder, and the process step S14 of subjecting the powder compact to an HDDR process.

Next, it will be described with reference to FIGS. 3(*a*) and 3(*b*) how the material changes its textures before and after the process step S14 (i.e., the HDDR process) shown in FIG. 2.

Figure 3:
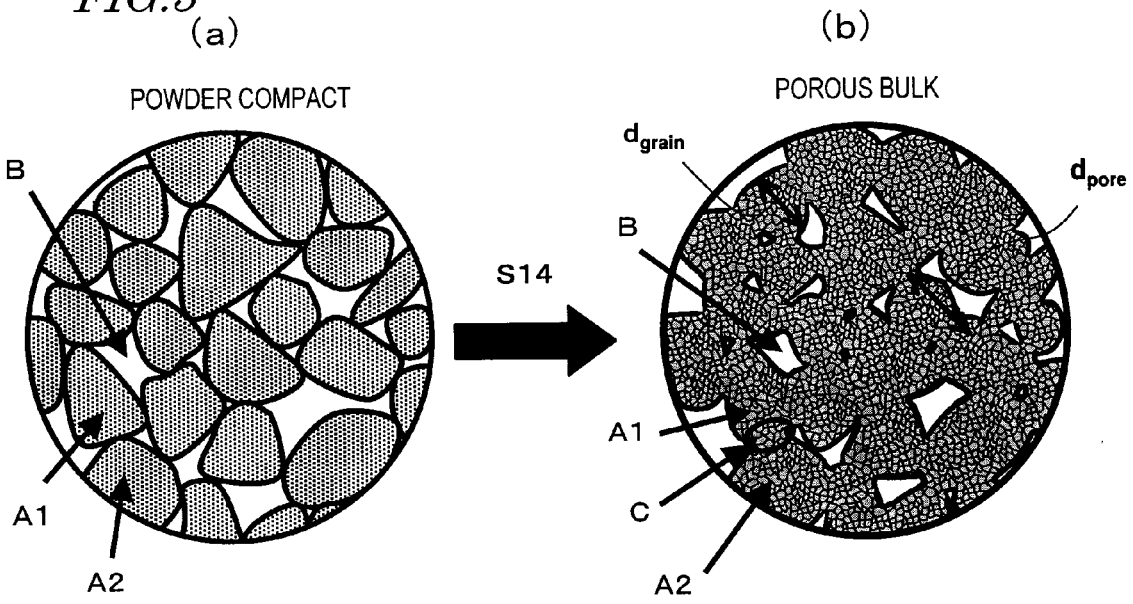
FIG. 3(*a*) is a schematic representation illustrating a powder compact (green compact) obtained by the process step S12 of the flowchart shown in FIG. 2 and FIG. 3(*b*) is a schematic representation illustrating how the material looks after the powder compact has been subjected to the HDDR process S14.

FIG. 3(*a*) is a schematic representation illustrating a powder compact (green compact) obtained by the process step S12. In this stage, respective fine particles that form the powder have been pressed and compacted together by going through the compaction process. For example, particles A1 and A2 are in contact with each other. Also, this powder compact has gaps B.

FIG. 3(*b*) is a schematic representation illustrating how the material looks after the powder compact has been subjected to the HDDR process S14. As a result of the HDDR reactions, every powder particle, including the particles A1 and A2, has an aggregate structure consisting of very fine $Nd_2Fe_{14}B$ type crystalline phases with an average grain size of 0.1 μm to 1 μm. Each particle (such as the particle A1) forms a strong bond with other particles (including the particle A2) as a result of diffusion of elements caused by the HDDR reactions. In FIG. 3(*b*), the bonding portion between the particles A1 and A2 is identified by the reference sign C.

The gaps B that were left inside the powder compact either shrink or disappear as shown in FIG. 3(*b*) as the sintering process advances as a result of the diffusion of elements. Nevertheless, the density has not yet been increased perfectly by the HDDR process and some gaps are still left as "micropores" even after the HDDR process. In FIG. 3(*b*), the major axis of the micropores is identified by the reference sign "$d_{pore}$". It should be noted that the mean particle size of the powder particles could be estimated by measuring the size $d_{grain}$ of portions of the particles between the micropores. Depending on how far the sintering process has advanced, it might be difficult to accurately figure out the mean particle size of the powder particles in the porous portion shown in FIG. 3(*b*). However, according to the present invention, the density of the porous portions falls within the range of 3.5 g/cm$^3$ to 7.0 g/cm$^3$ as described above. That is why by determining whether or not the major axis of the micropores in the porous portions and the measured density of the magnet fall within the ranges described above, it can be determine whether the porous structure shown in FIG. 3(*b*) has been formed or not. If the gaps were left intentionally to use them for any purpose (e.g., to introduce a different material there as will be described later), the porous portions more preferably have a density of 6.0 g/cm$^3$ or less, even more preferably 5.0 g/cm$^3$ or less.

In FIG. 3(*b*), only the $Nd_2Fe_{14}B$ type crystalline phases with an average grain size of 0.1 μm to 1 μm are shown as the aggregate structure. However, a rare-earth-rich phase or any other phase may be included as well.

According to the present invention, no resin for bonding powder particles together is needed unlike a bonded magnet, and properties as a magnet are achieved even in the form of a porous body in which gaps between the powder particles have become micropores. It is not yet completely clear why sufficient mechanical strength is achieved even though there are those gaps. This is probably because the powder particles used to form the powder compact have a small particle size and because the reaction caused by the diffusion of hydrogen during the HDDR process would advance the sintering process between the particles at a relatively low temperature and would contribute to increasing the bond strength between the particles.

In the prior art, if a powder compact has been subjected to an HDDR process, the powder particles that have aggregated together through the HDDR process are crushed and broken into pieces and then used to make a bonded magnet or the powder compact is dipped in a resin to increase its mechanical strength. This is because the powder compact that has been obtained by the HDDR process has too low mechanical strength to have a chance to use it as a magnet as it is.

According to the present invention, since the mechanical strength increases, the powder compact can be not only handled easily but also be subjected to some machining process (such as cutting and grinding) to achieve even higher size precision. That is why there is no need to dip the powder compact in a resin to fill the micropores but the powder compact may be used as a permanent magnet as it is.

After the HDDR process, the porous magnet of the present invention has a porous structure that communicates with the air (which will be referred to herein as an "open pore structure"). Thus, by introducing a different material either into the pores or onto the surface, a composite bulk magnet can be made easily or the performance of the magnet can be improved.

Optionally, by subjecting the porous magnet thus obtained to some hot working such as hot pressing, a full-dense bulk magnet can also be obtained while maintaining the good properties of the porous magnet. Also, if such hot working is applied to a composite material to which the different material described above has been introduced, a composite magnet, in which hard and soft magnetic phases are coupled together magnetostatically, can also be obtained.

According to the present invention, if the porous magnet and a compact of a soft magnetic material are combined and then subjected to a hot compaction process, a high-performance composite magnetic component, in which a soft magnetic yoke and magnets are assembled together, can be obtained.

Preferred Embodiments

Hereinafter, preferred embodiments of a method of making an R—Fe—B based porous magnet according to the present invention will be described in detail.

Starting Alloy

First, an ingot of an R-T-Q based alloy (which will be referred to herein as a "starting alloy") including an R—Fe—B phase as a hard magnetic phase is provided. In the R-T-Q based alloy, R is a rare-earth element, which includes at least 50 at % of Nd and/or Pr and may herein include yttrium (Y), T is at least one transition metal element selected from the group consisting of Fe, Co and Ni and including 50% or more of Fe, and Q is either B alone or B and C that substitutes for a portion of B.

This R-T-Q based alloy (starting alloy) includes at least 50 vol % of $Nd_2Fe_{14}B$ type compound phase (which will be simply referred to herein as "$R_2T_{14}Q$").

Most of the rare-earth element R included in the starting alloy forms $R_2T_{14}Q$ but some of the element R forms $R_2O_3$ and other phases. The mole fraction of the rare-earth element R preferably accounts for 10 at % to 30 at %, and more preferably 12 at % to 17 at %, of the overall starting alloy. Optionally, if a portion of R is replaced with Dy and/or Tb, the coercivity can be increased.

The mole fraction of the rare-earth element R is preferably defined such that the "content of extra rare-earth element R'" (to be described later) becomes equal to or greater than 0 at %, more preferably equal to or greater than 0.1 at %, and even more preferably equal to or greater than 0.3 at %, when the HD process is started. In this case, the content of extra rare-earth element R' is calculated by:

$$R' = \text{"at \% of } R\text{"} - \text{"at \% of } T\text{"} \times 1/7 - \text{"at \% of } O\text{"} \times 2/3$$

The content of extra rare-earth element R' means the mole fraction of one of the rare-earth elements R that is included in the R-T-Q based alloy (starting alloy) and that does not form $R_2T_{14}B$ or $R_2O_3$ but is present as a compound other than $R_2T_{14}B$ and $R_2O_3$. Unless the mole fraction of the rare-earth elements R is defined such that the content of extra rare-earth element R' becomes equal to or greater than 0 at % when the HD process is started, it would be difficult to obtain very small crystals with an average grain size of 0.1 μm to 1 μm by the method of the present invention. In the subsequent pulverization or compaction process, the rare-earth elements R could be oxidized by oxygen or water contained in the atmosphere. If the rare-earth elements R were oxidized, then the content of extra rare-earth element R' would decrease. For that reason, the various process steps before the HD process is started are preferably carried out in an atmosphere in which the concentration of oxygen is reduced as much as possible. However, since it is difficult to eliminate oxygen from the atmosphere completely, the mole fraction of R in the starting alloy is preferably defined with the potential decrease in R' due to oxidation in a subsequent process taken into account.

The upper limit of R' is not particularly defined but is preferably 5 at % or less, more preferably 3 at % or less, and even more preferably 2.5 at % or less, considering a potential decrease in corrosion resistance and $B_r$. Even if R' is equal to or smaller than 5 at %, the mole fraction of the rare-earth elements R is preferably not greater than 30 at %.

The concentration of oxygen in the magnet when the HD process is started is preferably reduced to at most 1 mass %, more preferably 0.6 mass % or less.

The mole fraction of Q preferably accounts for 3 at % to 15 at %, more preferably 5 at % to 8 at %, and even more preferably 5.5 at % to 7.5 at %, of the entire alloy.

T is the balance of the alloy. As described above, T is at least one transition metal element selected from the group consisting of Fe, Co and Ni and includes at least 50% of Fe. If a portion of T is Co and/or Ni, Co is preferred to Ni. Also, in view of cost and other considerations, the total content of Co preferably accounts for at most 20 at %, and more preferably 5 at % or less, of the entire alloy. Reasonably good magnetic properties would still be achieved even if no Co were included at all. However, if 0.5 at % or more of Co is included, more stabilized magnetic properties will be achieved.

To improve magnetic properties or achieve any other effect, an element such as Al, Ti, V, Cr, Ga, Nb, Mo, In, Sn, Hf, Ta, W, Cu, Si or Zr may be added appropriately. However, if the amount of such an additive were increased, the saturation magnetization, among other things, would decrease significantly. That is why the total content of these additives is preferably at most 10 at %.

According to the conventional method of making an HDDR magnet powder and according to the manufacturing process disclosed in Patent Document No. 6, the magnet powder to be subjected to the HDDR process has a mean particle size of 30 μm or more, and typically 50 μm or more. To make respective particles of the magnet powder exhibit good magnetic anisotropy after the HDDR process, the easy magnetization axes of the respective particles need to be aligned with one direction in the material powder. For that purpose, the starting alloy ingot yet to be pulverized is made such that the average size of the regions in which the crystallographic orientations of the $Nd_2Fe_{14}B$ type crystalline phases are aligned with one direction is greater than the mean particle size of the pulverized powder particles.

Consequently, according to the conventional method of making an HDDR magnet powder and the process disclosed in Patent Document No. 6, a material alloy is made by a book molding process, a centrifugal casting process or any other process and then is subjected to a heat treatment process such as a homogenizing heat treatment, thereby growing crystalline phases.

However, the present inventors discovered and confirmed via experiments that in such a material alloy in which the $Nd_2Fe_{14}B$ type compound had been grown excessively by the book molding process or the centrifugal casting process, it was difficult to completely remove α-Fe, or initial crystals formed by casting, and α-Fe remaining in the material alloy had a harmful effect on the magnetic properties after the HDDR process.

According to the manufacturing process of the present invention, a powder with a mean particle size that is less than 10 μm is used, and there is no need to increase the size of the main phase of the material alloy unlike the conventional method of making an HDDR magnet powder. For that reason, even if an alloy obtained by rapidly cooling and solidifying a molten alloy by a strip casting process (i.e., a strip cast alloy) were used, high anisotropy could still be achieved after the HDDR process. In addition, by pulverizing such a rapidly solidified alloy into powder, the content of remaining α-Fe can be reduced compared to the material alloy (starting alloy) obtained by the conventional book molding process, for example. As a result, the deterioration in magnetic properties after the HDDR process can be minimized and good loop squareness is realized.

Optionally, the magnet of the present invention can also be made of a material alloy that has been prepared by a rapid cooling process other than the strip casting process (e.g., an atomization process), a book molding process or a centrifugal casting process. Also, in order to homogenize the texture of the material alloy, for example, the material alloy yet to be pulverized may be thermally treated as well. Such a heat treatment process is typically carried out at a temperature of at least 1,000° C. within a vacuum or an inert atmosphere.

Material Powder

Next, a material powder is made by pulverizing the material alloy (starting alloy) by a known process. In this preferred embodiment, the starting alloy is coarsely pulverized by either a mechanical pulverization process using a jaw crusher, for example, or a hydrogen occlusion pulverization process to obtain a coarse powder with a size of about 50 μm to about 1,000 μm. Subsequently, this coarse powder is finely pulverized with a jet mill, for example, thereby obtaining a material powder that typically has a mean particle size of less than 10 μm.

To obtain a porous bulk magnet with sufficiently high mechanical strength, it is effective to optimize the mean particle size of the material powder. However, it is no less effective to control the alloy composition (among other things, the mole fractions of the rare-earth element R or the extra rare-earth element R') or an HDDR process condition (the HDDR process temperature, in particular). By optimizing the alloy composition and HDDR process condition, similar effects to those of the present invention would be achieved even if the mean particle size of the material powder exceeded 10 μm.

For safety considerations, the material powder to handle preferably has a mean particle size of at least 1 μm. This is because if the mean particle size were less than 1 μm, the material powder would react with oxygen in the air more easily and would be more likely to generate too much heat or start a fire due to oxidation. To handle the material powder more easily, the material powder preferably has a mean particle size of 3 μm or more. On the other hand, to increase the mechanical strength of the resultant compact, the upper limit of the mean particle size is preferably 9 μm, more preferably 8 μm.

The mean particle size of the conventional HDDR magnet powder exceeds 10 μm and usually falls within the range of 50 μm to 500 μm. The present inventors discovered and confirmed via experiments that if a material powder with such a large mean particle size were subjected to the HDDR process, the resultant magnetic properties would be either insufficient especially in terms of coercivity and loop squareness of demagnetization curve or even extremely poor. The magnetic properties would deteriorate due to the loss of homogeneity of reactions during the HDDR process (and during the HD reaction among other things). The greater the size of powder particles, the more easily the reactions would lose its homogeneity. If the HDDR reactions advanced non-homogenously, then the texture and crystal grain size could be non-homogenous or non-uniform, or unreacted portions could be created, inside the powder particles, thus resulting in deteriorated magnetic properties.

To advance the HDDR reactions uniformly, it is effective to shorten the time for completing the HDDR reactions. However, if the reaction rate were increased by adjusting the hydrogen pressure, for example, then the degree of alignment would vary among crystals, thus decreasing the anisotropy of the magnet powder. As a result, good loop squareness could not be achieved.

According to the present invention, the powder compact, obtained by compressing the powder, is subjected to the HDDR process. Inside the powder compact, there are gaps that are large enough to allow the hydrogen gas to pass and diffuse between the powder particles. Also, according to the present invention, a material powder, of which the mean particle size is typically in the range of 1 μm to less than 10 μm, is used. That is why the hydrogen gas can easily move all through the powder particles and the HD and DR reactions can be advanced in a short time, thus homogenizing the texture that has gone through the HDDR process. As a result, good magnetic properties (excellent loop squareness, among other things) are achieved and the HDDR process can get done in a shorter time.

Next, the material powder described above is compacted to make a powder compact. The process of making the powder compact is preferably carried out under a magnetic field of 0.5 T to 20 T (such as a static magnetic field or a pulse magnetic field) with a pressure of 10 MPa to 200 MPa applied. This compaction process may be performed using a known powder press machine. The powder compact that has just been unloaded from the powder press machine has a green density of about 3.5 g/cm$^3$ to about 5.2 g/cm$^3$.

This compaction process may be carried out without applying a magnetic field. If no magnetic field alignment were carried out, an isotropic porous magnet would be obtained eventually. To achieve better magnetic properties, however, the compaction process is preferably carried out with magnetic field alignment such that an anisotropic porous magnet is obtained in the end.

The process of pulverizing the starting alloy and the process of compacting the material powder are preferably carried out with the oxidation of the rare-earth element minimized to prevent the content of the extra rare-earth element R' in the magnet just before the HD process from being less than 0 at %. To reduce the oxidation of the material powder, the respective processes and handling between the respective processes are preferably carried out in an inert atmosphere in which the concentration of oxygen is reduced as much as possible. Optionally, a commercially available powder, of which the content of R' is equal to or greater than a predetermined value, may be purchased and the atmosphere may be controlled during the respective processes to be performed after that and during handling between those processes.

Also, for the purpose of improving the magnetic properties or for any other purpose, a mixture of the starting alloy yet to be pulverized and another alloy may be finely pulverized and then the fine powder may be compacted into a powder compact. Alternatively, after the starting alloy has been finely pulverized, the fine powder may be mixed with a powder of another metal, alloy and/or compound and the mixture may be compacted into a powder compact. Still alternatively, the powder compact may be dipped in a solution in which a metal, alloy and/or compound is/are dispersed or dissolved and then the solvent may be vaporized off. When any of these alternative methods is adopted, the composition of the alloy powder preferably falls within the ranges described above as a mixed powder.

HDDR Process

Next, the powder compact (or green compact) obtained by the compaction process is subjected to the HDDR process.

According to this preferred embodiment, even if the material powder particles cracked during the compaction process, the magnetic properties would not be affected because the powder particles are subjected to the HDDR process after that.

The conditions of the HDDR process are set appropriately according to the types and amounts of the additive elements and may be determined by reference to the process conditions of the conventional HDDR process. In this preferred embodiment, a powder compact of powder particles with a relatively small mean particle size of 1 μm to 10 μm is used, and therefore, the HDDR reactions can be completed in a shorter time than the conventional HDDR process.

The temperature increasing process step to produce the HD reactions may be carried out in a hydrogen gas atmosphere with a hydrogen partial pressure of 10 kPa to 500 kPa, a mixed atmosphere of hydrogen gas and an inert gas (such as Ar or He), an inert atmosphere or a vacuum. If the temperature increasing process step is carried out in an inert atmosphere or in a vacuum, the following effects will be achieved:

(1) The collapse of the powder compact, which could be caused by hydrogen occlusion during the temperature increasing process step, can be avoided;

(2) The deterioration in magnetic properties, which could be caused due to difficulty in controlling the reaction rate during the temperature increase, can be reduced; and (3) The temperature increase will melt the rare-earth alloy and/or rare-earth compound with low melting points, advance the shrinkage of the powder compact, and eventually make a porous magnet with high strength.

The HD process is carried out within either a hydrogen gas atmosphere or a mixture of hydrogen gas and inert gas (such as Ar or He) with a hydrogen partial pressure of 10 kPa to 500 kPa at a temperature of 650° C. to less than 1,000° C. During the HD process, the hydrogen partial pressure is more preferably 20 kPa to 200 kPa and the process temperature is more preferably 700° C. to 900° C. The time for getting the HD process done may be 5 minutes to 10 hours, and is typically defined within the range of 10 minutes to 5 hours. In this preferred embodiment, the material powder has a small mean particle size, and therefore, the HD reactions can be completed in a relatively short time.

If in T of the R-T-Q based alloy, Co accounts for 3 at % or less of the entire alloy, the partial pressure of hydrogen during the temperature increasing process step and/or the HD process is preferably 5 kPa to 100 kPa and more preferably 10 kPa to 50 kPa. Then, the decrease in anisotropy that could be caused by the HDDR process can be minimized.

The HD process is followed by the DR process. The HD and DR processes may be carried out either continuously in the same system or discontinuously using two different systems.

The DR process is performed within either a vacuum or an inert atmosphere at a temperature of 650° C. to 1,000° C. The process time is normally 5 minutes to 10 hours and is typically defined within the range of 10 minutes to 2 hours. Optionally, the atmosphere could be controlled stepwise (e.g., the hydrogen partial pressure or the reduced pressure could be further reduced step by step).

A sintering reaction is produced all through the HDDR process including the temperature increasing process step before the HD reaction. As a result, the powder compact becomes a porous sintered magnet having micropores with a major axis of 1 μm to 20 μm. The mechanism of sintering occurring during these processes should be different from that of sintering occurring during the manufacturing process of a normal R—Fe—B based sintered magnet. However, it is not yet quite clear exactly how and where these two mechanisms are different from each other.

As a result of the sintering reaction occurring during the HDDR process, the powder compact shrinks at a shrinkage rate (which is calculated as ((size of compact yet to be subjected to HDDR process−size of compact subjected to HDDR process)/size of compact yet to be subjected to HDDR process×100) of about 2% to about 10%. However, the anisotropy of shrinkage is not significant. Specifically, in this preferred embodiment, the shrinkage ratio (i.e., shrinkage rate in magnetic field direction/shrinkage rate in die pressing direction) is in the range of about 1.1 to about 1.6. That is why sintered magnets can be formed in various shapes that have been difficult to form for conventional sintered magnets (with a shrinkage ratio of typically two or more).

Since the overall HDDR process is carried out within an atmosphere with a reduced oxygen concentration, the content of the extra rare-earth element R' just before the HD process becomes approximately equal to, or greater than, the content of R' right after the DR process. That is why by measuring the content of R' right after the DR process, it can be confirmed that the R' value just before the HD process is equal to or greater than a desired value. Nevertheless, as the surface layer of the porous magnet could be oxidized and turn into black by a very small content of oxygen or water contained in the atmosphere during the HDDR process, the content of R' right after the DR process is preferably measured after the oxidized surface layer has been removed.

According to this preferred embodiment, after the compaction process, the powder compact (green compact) is subjected to the HDDR process. That is to say, no powder compaction process is carried out after the HDDR process. That is why once the HDDR process is finished, the magnetic powder is never pulverized under a compacting pressure. As a result, higher magnetic properties are achieved compared to a bonded magnet obtained by compressing an HDDR powder. Consequently, according to this preferred embodiment, the loop squareness of the demagnetization curve improves, and therefore, good magnetization property and good thermal resistance are achieved at the same time.

In addition, according to this preferred embodiment, the alignment and retentivity problems of a conventional anisotropic bonded magnet to be produced with an HDDR powder can also be overcome and radial or polar anisotropy can be given to the magnet as well. Also, the present invention has nothing to do with the essentially low productivity of a hot compaction process, either.

Besides, according to this preferred embodiment, the density of the powder compact is increased while the HDDR reactions are advanced. That is why cracks produced in a magnet due to variations in volume during the HD and DR reactions and other problems can be avoided, too. Furthermore, since the HDDR reactions advance at the surface and inside of the powder compact substantially simultaneously, a magnet of a big size can be produced easily.

Process of Heating and Compressing Porous Magnet

The porous material (magnet) obtained by the method described above may be used as a bulk permanent magnet as it is. Optionally, if the material is further subjected to a heating and compression process such as a hot pressing process, the density of the material can be increased so much as to obtain a full-dense magnet. Hereinafter, a specific preferred embodiment will be described as to how to make a full-dense magnet by a heating and compression process. The porous magnet may be heated and compressed by a known heating and compression process such as hot pressing, SPS (spark plasma sintering), hot isostatic pressing process (HIP) or hot rolling. Among other things, hot pressing and SPS are particularly preferred because the magnet can be formed in a desired shape relatively easily by any of these two techniques. In this preferred embodiment, hot pressing is carried out in the following procedure.

Figure 4:
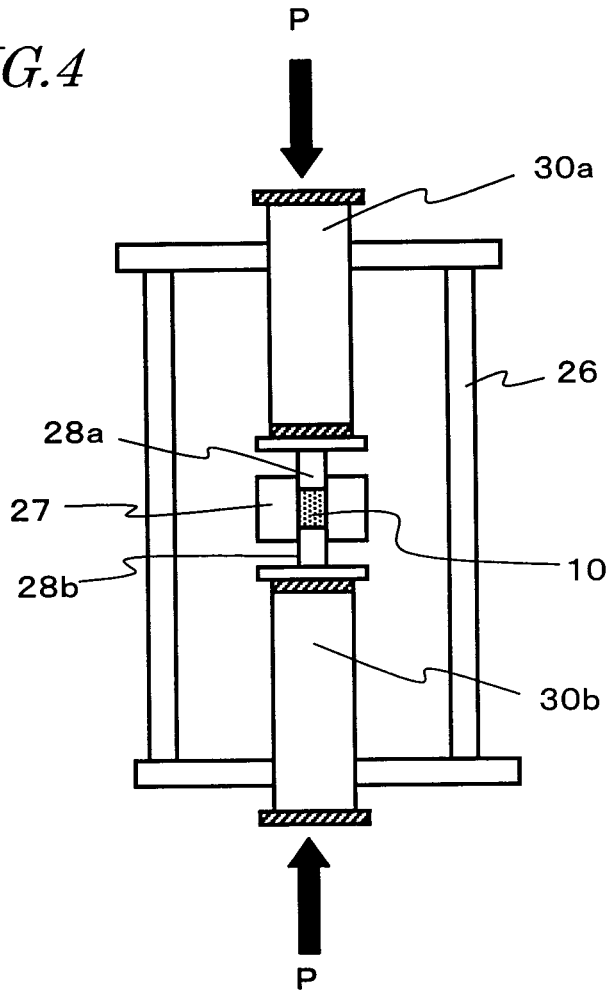
FIG. 4 illustrates an exemplary configuration for a machine for heating and compressing a porous magnet.

In this preferred embodiment, a hot press machine with the configuration shown in FIG. 4 is used. This machine includes a die 27 with an opening at the center, upper and lower punches 28*a* and 28*b* for pressing the given porous magnet, and driving portions 30*a* and 30*b* for moving these punches 28*a* and 28*b* up and down.

The die 27 shown in FIG. 4 is loaded with a porous magnet (which is identified by the reference numeral 10 in FIG. 4) that has been produced by the method described above. In this process step, the magnet is preferably loaded such that the magnetic field direction (i.e., alignment direction) agrees with the press direction. The die 27 and the punches 28*a* and 28*b* are made of a material that can withstand the heating temperature and the pressure applied within the atmospheric gas used. As such a material, carbon or a cemented carbide such as tungsten carbide is preferably used. If the outer dimension of the porous magnet 10 is set to be smaller than the opening size of the die 27, the degree of anisotropy can be increased. Next, the die 27 that is now loaded with the porous magnet 10 is put in place in the hot press machine, which preferably includes a chamber 26 where either an inert atmosphere or a vacuum controlled at $10^{-1}$ Torr or more can be created. The chamber 26 is equipped with a heater of a resistance heating type such as a carbon heater and a cylinder for compressing the given sample under pressure.

After the chamber 26 is filled with a vacuum or an inert atmosphere, the die 27 is heated with the heater, thereby increasing the temperature of the porous magnet 10, which is now loaded in the die 27, to 600° C. to 900° C. In this process step, the porous magnet 10 is pressed with a pressure P of 0.1 ton/cm$^2$ to 3.0 ton/cm$^2$. The porous magnet 10 preferably starts to be pressed after the temperature of the die 27 has reached a predetermined level. After the magnet 10 has been kept heated at 600° C. to 900° C. for 10 minutes or more while being pressed, the magnet will be cooled. When the magnet, of which the density has been increased to a full density by the heating and compression process, is cooled to a temperature that is low enough to avoid oxidation (e.g., approximately 100° C. or less) due to exposure to the air, the magnet of this preferred embodiment is unloaded from the chamber. In this manner, an R—Fe—B based magnet of this preferred embodiment can be obtained based on the porous magnet described above.

The density of the magnet thus obtained reaches 95% or more of its true density. Also, according to this preferred embodiment, in the resultant aggregate structure of crystalline phases, crystal grains with b/a ratios that are less than two account for 50 vol % or more of all crystal grains, where the b/a ratio is the ratio of the longest grain size b of the crystal grains to the shortest one a. In this respect, the magnet of this preferred embodiment is quite different from the conventional anisotropic bulk magnet produced by hot plastic working as disclosed in Japanese Patent Application Laid-Open Publication No. 02-39503, for example. The crystal structure of such a magnet consists mostly of flat crystal grains with b/a ratios that are greater than two, where the b/a ratio is also the ratio of the longest grain size b to the shortest one a.

It should be noted that such a heating and compression process is applicable to not just the porous magnet of this preferred embodiment but also a porous material (magnet) including a different material in its micropores to be described later.

Introduction of Different Material into Porous Magnet

The micropores of the R—Fe—B based porous material (magnet) obtained by the method described above communicate with the air even in their deepest portions, and a different material may be introduced into the pores either by a dry process or a wet process. Examples of the different materials include rare-earth metals, rare-earth alloys and/or rare-earth compounds, iron and alloys thereof. Hereinafter, a specific preferred embodiment thereof will be described.

(1) Introduction of Different Material by Wet Process

Examples of wet processes that can be performed on an R—Fe—B based porous material include electroplating process, electroless plating process, chemical conversion process, alcohol reduction process, carbonyl metal decomposition process, and sol-gel process. According to any of these processes, the surface of the porous material inside the micropores can be covered with a coating or layer of fine particles through chemical reactions. Alternatively, the wet process of the present invention may also be performed even by providing a colloidal solution in which fine particles are dispersed in an organic solvent and dipping the pores of the R—Fe—B based porous material with the solution. In that case, the micropores can be coated with a layer of the fine particles that have been dispersed in the colloidal solution by vaporizing the organic solvent of the colloidal solution that has been introduced into the micropores of the porous material. When a wet process is performed as any of these processes, heating or ultrasonic wave application may be performed as an additional process to promote the chemical reactions or impregnate the porous material with the fine particles just as intended even in its deepest portions.

Hereinafter, a wet process that uses a colloidal solution will be described in detail.

The fine particles to be dispersed in the colloidal solution may be made by a known process that may be either a vapor phase process such as a plasma CVD process or a liquid phase process such as a sol-gel process. If the fine particles are made by a liquid phase process, its solvent may or may not be the same as that of the colloidal solution.

The fine particles preferably have a mean particle size of 100 nm or less. This is because if the mean particle size exceeded 100 nm, it would be difficult to impregnate the R—Fe—B based porous material with the colloidal solution to the deepest portions thereof. Meanwhile, the lower limit of the particle sizes of the fine particles is not particularly defined as long as the colloidal solution can keep stability. In general, if the particle size of the fine particles were less than 5 nm, the stability of a colloidal solution would decrease often. That is why the particle size of the fine particles is preferably at least equal to 5 nm.

The solvent to disperse the fine particles in may be appropriately selected according to the particle size or a chemical property of the fine particles. However, as the R—Fe—B based porous material does not have such high corrosion resistance, a non-aqueous solvent is preferably used. Optionally, to prevent the fine particles from coagulating, the colloidal solution may include a disperser such as a surfactant.

The concentration of the fine particles in the colloidal solution may be determined appropriately by the particle size or a chemical property of the fine particles or the type of solvent or the disperser. The fine particles may have a concentration of about 1 mass % to about 50 mass %, for example.

If a rare-earth porous material is immersed in such a colloidal solution, the colloidal solution will penetrate even into the micropores deep inside the rare-earth porous material through a capillarity phenomenon. To impregnate the inside of the porous material with the colloidal solution more perfectly, it is effective to remove the air that is present inside the micropores of the porous material. That is why the impregnation process is preferably carried out by creating either a reduced pressure atmosphere or a vacuum once and then raising the pressure back to, or even beyond, a normal pressure.

In the porous material yet to be subjected to the impregnation process, debris of a machining process such as grinding might fill the micropores on the surface of the porous material, thus possibly interfering with perfect impregnation. For that reason, before the impregnation process, the surface of the porous material is preferably cleaned by ultrasonic cleaning, for example.

After the porous material has been subjected to the impregnation process, the solvent of the colloidal solution is vaporized. The vaporization rate of the solvent changes according to the type of the solvent. Some solvent can be vaporized sufficiently at room temperature and in the air. However, the vaporization is preferably accelerated by heating the colloidal solution and/or reducing the pressure as needed.

The material introduced by the wet process does not have to fill the micropores entirely but just needs to be present on the surface of the micropores. However, the material preferably covers the surface of the micropores to say the least.

Hereinafter, it will be described, as a specific example of the present invention, how to form a coating of Ag particles on the surface of micropores of a porous magnet material using a colloidal solution in which the Ag particles are dispersed.

Specifically, a porous magnet material, which was made by the method to be described later for a fifth specific example of the present invention so as to have dimensions of 7 mm×7 mm×5 mm, was subjected to ultrasonic cleaning and then immersed in a nanoparticle dispersed colloidal solution. This colloidal solution was Ag Nanometal Ink (produced by Ulvac Materials, Inc.) in which the Ag particles had a mean particle size of 3 μm to 7 μm and of which the solvent was tetradecane and the solid matter concentration was 55 mass % to 60 mass %. The nanoparticle dispersed colloidal solution was put into a glass container, which was then loaded into a vacuum desiccator with the porous material immersed in the solution and put under a reduced pressure. During the process, the atmospheric gas pressure was adjusted to about 130 Pa.

Due to the reduced pressure, bubbles were produced in the porous material and in the nanoparticle dispersed colloidal solution. And when the bubbles were no longer produced, the pressure was once raised to the atmospheric pressure. Thereafter, the porous material was inserted into a vacuum dryer and then heated to 200° C. under an atmospheric gas pressure of about 130 Pa, thereby vaporizing the solvent and drying the material. In this manner, a sample of a composite bulk material according to the present invention was obtained.

Also, as long as the situation permits, this series of process steps (and the drying process step among other things) is preferably carried out in an inert gas such as Argon gas (or in a vacuum if possible) to prevent the porous material with a big surface area from being oxidized.

Figure 5:
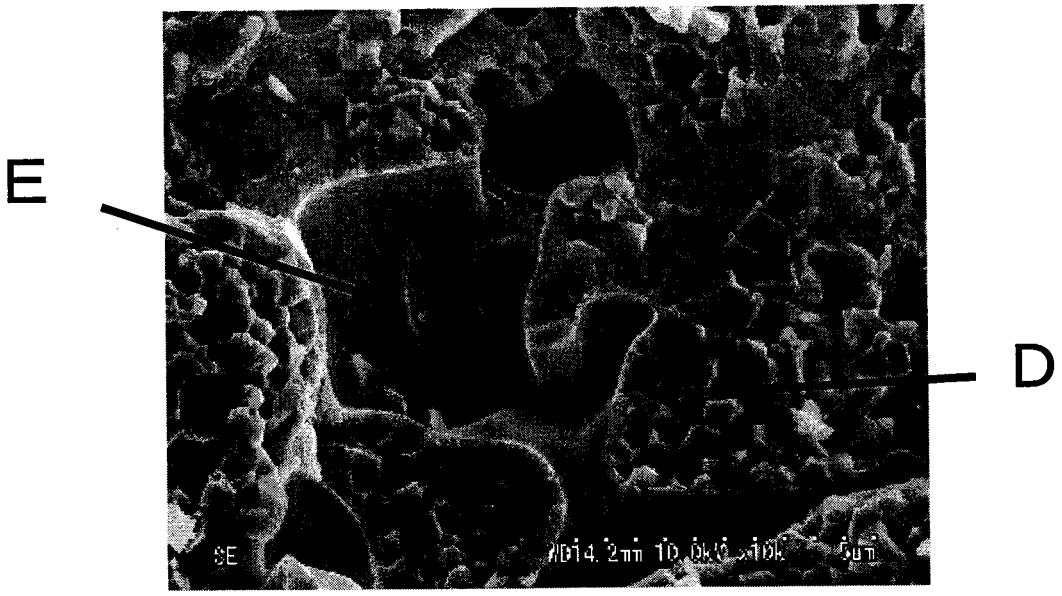
FIG. 5 is an SEM photograph showing a fractured face of a porous material prepared by the present invention.

FIG. 5 is an SEM photograph showing a fractured face of the porous material (composite bulk material) that was already subjected to the impregnation process.

In the photograph shown in FIG. 5, the region D is the fractured face of the porous material and the region E is a micropore, of which the surface is covered with a coating that is filled with fine particles with sizes of several to several tens of nanometers. This coating of fine particles would have been formed by the Ag nanoparticles, which had been dispersed in the nanoparticle dispersed colloidal solution, transported along with the solvent through the micropores of the porous material, and then left in the micropores even after the solvent was vaporized. Such a coating of Ag nanoparticles was observed at the core of the sample, too.

In this manner, the fine particles can be introduced to the core of the porous material through the micropores thereof.

Alternatively, by using an acrylic, urethane or any other resin as a different material from the R—Fe—B based porous material, impregnating the resin with the solution, and then heating and curing it, the environmental resistance of the porous magnet material can be increased.

Optionally, such an R—Fe—B based porous material, in which a different material from the R—Fe—B based porous material has been introduced into the micropores by a wet process, may be further subjected to a heating process to improve the properties thereof. The temperature of the heating process is appropriately set according to the purpose of the heating process. However, if the temperature of the heating process were equal to or higher than 1,000° C., the size of the aggregate structure in the R—Fe—B based porous material would increase too much to maintain good magnetic properties. For that reason, the temperature of the heating process is preferably less than 1,000° C. The heating atmosphere is preferably either a vacuum or an inert gas such as Ar gas in order to prevent the magnetic properties of the R—Fe—B based porous material from deteriorating due to oxidation or nitrification.

It should be noted that according to the combination of the R—Fe—B based porous material and a different material, the R—Fe—B based porous material could have no coercivity $H_{cJ}$. In that case, a permanent magnet material that can have a coercivity $H_{cJ}$ of 400 kA/m or more can be made by performing this process step and a heating and compressing process step.

The HD process and the DR process do not always have to be carried out continuously. Also, a metal, alloy and/or compound may be introduced, by the same method as that described above, as a different material into a powder compact that has been subjected to the HD process and then the material may be subjected to the DR process. In that case, in the powder compact that has been subjected to the HD process, particles have already been diffused and bonded together to the point that the powder compact can be handled much more easily than the powder compact yet to be subjected to the HD process. That is why the metal, alloy and/or compound can be introduced easily.

Also, if the heating and compressing process described above is applied to the porous material (composite bulk material) that has been subjected to the wet process, then a composite bulk magnet, of which the density is as high as 95% or more of its true density, can be obtained.

A method of introducing a different material by a wet process has been described. However, to introduce a rare-earth element as the different material, the following method is preferably adopted.

(2) Introducing rare-earth element

The rare-earth metal, rare-earth alloy or rare-earth compound to be introduced onto the surface and/or into the micropores of the R—Fe—B based porous material is not particularly limited as long as it includes at least one rare-earth element. To achieve the effect of the present invention significantly, however, it preferably includes at least one of Nd, Pr, Dy and Tb.

There are various methods for introducing at least one of rare-earth metals, rare-earth alloys, and rare-earth compounds onto the surface and/or into the micropores of the R—Fe—B based porous material and the present invention is in no way limited to any one of them. Those introducing methods available are roughly classifiable into dry processes and wet processes. Hereinafter, these two types of methods will be described specifically.

(A) Dry Processes

Examples of known dry processes adoptable include physical vapor deposition processes such as a sputtering process, a vacuum evaporation process and an ion plating process. Alternatively, a powder of at least one of rare-earth metals, rare-earth alloys and rare-earth compounds (such as hydrides) may be mixed with an R—Fe—B based porous material, and the mixture may be heated, thereby diffusing the rare-earth element into the R—Fe—B based porous material. Still alternatively, as disclosed in PCT/JP2007/53892, a method of diffusing a rare-earth element into an R—Fe—B based porous material while vaporizing and evaporating the element from a rare-earth containing material (which is so-called an "evaporation/diffusion process") may also be adopted.

The temperature of the porous material during the dry process may be room temperature or may have been increased by heating. However, if the temperature were equal to or higher than 1,000° C., the aggregate structure in the R—Fe—B based porous material would increase its size too much to avoid deterioration in magnetic properties. For that reason, the temperature of the porous material during the dry process is preferably less than 1,000° C. By adjusting the temperature and time of the dry process appropriately, it is possible to prevent the aggregate structure from growing coarsely. Depending on the condition of such a heat treatment, the porous material could get even denser. However, if the heat treatment is carried out to prevent the aggregate structure from growing coarsely, micropores will remain in the porous material. That is why to increase the density of the porous material fully, the porous material should be thermally treated while being pressed.

The atmosphere for the dry process may be appropriately selected according to the specific type of the process to perform. If oxygen or nitrogen were included in the atmosphere, the magnetic properties might deteriorate due to oxidation or nitrification during the process. In view of this consideration, the dry process is preferably performed in either a vacuum or an inert atmosphere (such as argon gas).

(B) Wet Processes

As the wet process, an appropriate one of the known processes mentioned above may also be performed. Among other things, a method of impregnating the pores of an R—Fe—B based porous material with a solution prepared by dispersing fine particles in an organic solvent (which will be referred to herein as a "process solution") is particularly preferred. In that case, the micropores can be coated with a layer of the fine particles that have been dispersed in the process solution by vaporizing the organic solvent of the colloidal solution that has been introduced into the micropores of the porous material. When a wet process is performed as any of these processes, heating or ultrasonic wave application may be performed as an additional process to promote the chemical reactions or impregnate the porous material with the fine particles just as intended even in its deepest portions.

The fine particles to be dispersed in the process solution may be made by a known process that may be either a vapor phase process such as a plasma CVD process or a liquid phase process such as a sol-gel process. If the fine particles are made by a liquid phase process, its solvent (dispersion medium) may or may not be the same as that of the process solution.

The fine particles to be dispersed in the process solution preferably include at least one of rare-earth oxides, fluorides and fluoride oxides. Particularly if a fluoride or a fluoride oxide is used, the rare-earth element can be diffused efficiently in the grain boundary of crystal grains that form the porous material by the heating process to be described later.

The fine particles preferably have a mean particle size of 10 μm or less. This is because if the mean particle size exceeded 1 μm, it would be difficult to disperse the fine particles in the process solution or to impregnate the R—Fe—B based porous material with the process solution to the deepest portions thereof. The mean particle size is more preferably 0.5 μm or less and even more preferably 0.1 μm (=100 nm) or less. The lower limit of the particle sizes of the fine particles is not particularly defined as long as the process solution can keep stability. In general, if the particle size of the fine particles were less than 1 nm, the stability of a process solution would decrease often. That is why the particle size of the fine particles is preferably at least equal to 1 nm, more preferably 3 nm or more, and even more preferably 5 nm or more.

The solvent (dispersion medium) to disperse the fine particles in may be appropriately selected according to the particle size or a chemical property of the fine particles. However, as the R—Fe—B based porous material does not have such high corrosion resistance, a non-aqueous solvent is preferably used. Optionally, to prevent the fine particles from coagulating, the process solution may include a disperser such as a surfactant or the fine particles may be subjected to a surface treatment in advance.

The concentration of the fine particles in the process solution may be determined appropriately by the particle size or a chemical property of the fine particles or the type of solvent or the disperser. The fine particles may have a concentration of about 1 mass % to about 50 mass %, for example.

If a rare-earth porous material is immersed in such a process solution, the process solution will penetrate even into the micropores deep inside the rare-earth porous material through a capillarity phenomenon. To impregnate the inside of the porous material with the process solution more perfectly, it is effective to remove the air that is present inside the micropores of the porous material. That is why the impregnation process is preferably carried out by creating either a reduced pressure atmosphere or a vacuum once and then raising the pressure back to, or even beyond, a normal pressure.

In the porous material yet to be subjected to the impregnation process, debris of a machining process such as grinding might fill the micropores on the surface of the porous material, thus possibly interfering with perfect impregnation. For that reason, before the impregnation process, the surface of the porous material is preferably cleaned by ultrasonic cleaning, for example.

After the porous material has been subjected to the impregnation process, the solvent (dispersion medium) of the process solution is vaporized. The vaporization rate of the solvent changes according to the type of the solvent. Some solvent can be vaporized sufficiently at room temperature and in the air. However, the vaporization is preferably accelerated by heating the process solution and/or reducing the pressure as needed.

The material introduced by the wet process does not have to fill the micropores entirely but just needs to be present on the surface of the micropores. However, the material preferably covers the surface of the micropores to say the least.

Optionally, such an R—Fe—B based porous material, in which a rare-earth element has been introduced onto the surface and/or into the micropores by the process described above, may be further subjected to a heating process to improve the properties (coercivity among other things) thereof. The temperature of the heating process is appropriately set according to the purpose of the heating process. However, if the temperature of the heating process were equal to or higher than 1,000° C., the size of the aggregate structure in the R—Fe—B based porous material would increase too much to maintain good magnetic properties. For that reason, the temperature of the heating process is preferably less than 1,000° C. The heating atmosphere is preferably either a vacuum or an inert gas such as Ar gas in order to prevent the magnetic properties of the R—Fe—B based porous material from deteriorating due to oxidation or nitrification.

It should be noted that according to the combination of the R—Fe—B based porous material and the rare-earth metal, rare-earth alloy or rare-earth compound, the R—Fe—B based porous material could have no coercivity $H_{cJ}$. In that case, a permanent magnet material that can have high coercivity $H_{cJ}$ can be made by performing this process step or the heating and compressing process step to be described later.

Also, if the heating and compressing process described above is applied to the porous material (composite bulk material) into which the rare-earth element has already been introduced, then a composite bulk magnet, of which the density is as high as 95% or more of its true density, can be obtained.

As the last process step, a magnetization process that would achieve high coercivity, which is one of the effects of the present invention, is carried out. The magnetization process is preferably performed after the wet process. If the heating and compressing process step is performed, the magnetization process is preferably performed after the heating and compressing process step.

Optionally, the porous magnet, full-dense magnet or composite magnet obtained by the method described above may be pulverized into powder and then used as a material powder to make a bonded magnet.

Composite Parts Including Porous Magnets

Using porous magnets obtained by the present invention, various composite parts can be made. As an exemplary application, a specific preferred embodiment of the present invention will be described as a method of making a formed product in which a rare-earth magnet compact and a soft magnetic material powder compact are assembled together by performing a hot press compaction (i.e., the heating and compressing process) on the porous magnet and a powder of a soft magnetic material or a green compact of the soft magnetic material powder.

Figure 6:
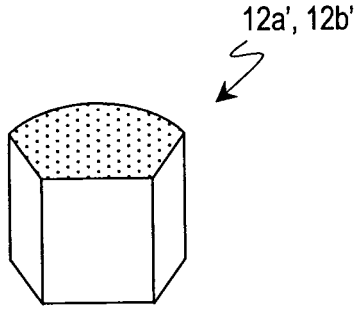
FIGS. 6(*a*) through 6(*c*) are schematic representations illustrating how to make a rotor 100 according to a preferred embodiment of the present invention.
Figure 6:
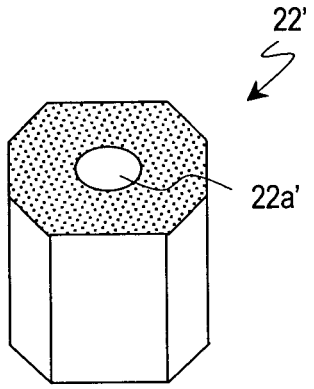
Figure 6:
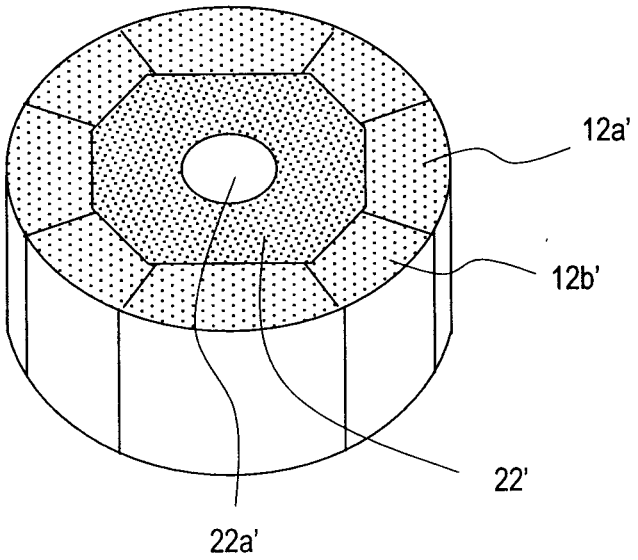

In this preferred embodiment, porous magnets 12*a*' and 12*b*' with the shape shown in FIG. 6(*a*) are made by the method described above, while a green compact 22' of a soft magnetic material powder as shown in FIG. 6(*b*) is also made separately by pressing and compacting the soft magnetic material powder (e.g., a soft magnetic metallic powder such as iron powder). The latter process step may be a known press compaction process. The pressure applied is preferably in the range of 300 MPa to 1 GPa. In this process, the density (i.e., the tap density) of the green compact 22' of the soft magnetic material powder preferably falls within the range of approximately 70 to 90%, more preferably approximately 75 to 80%, of its true density. If the pressure were short of the range specified above, the magnitude of deformation (or shrinkage) during the integrating process step by hot pressing would be too much to avoid deviations in relative positions of the magnet parts and soft magnetic parts, thus sometimes making it difficult to form a magnetic circuit component with high size accuracy. On the other hand, if the pressure were beyond the range specified above, sufficient bond strength could not be achieved by the subsequent integrating process step. The compacting temperature is preferably approximately 15 to 40° C. and there is no need to heat or cool them in particular. To prevent the rare-earth magnet powder from being oxidized, the atmosphere is preferably an inert gas (which may also be a rare gas or nitrogen gas).

Figure 7:
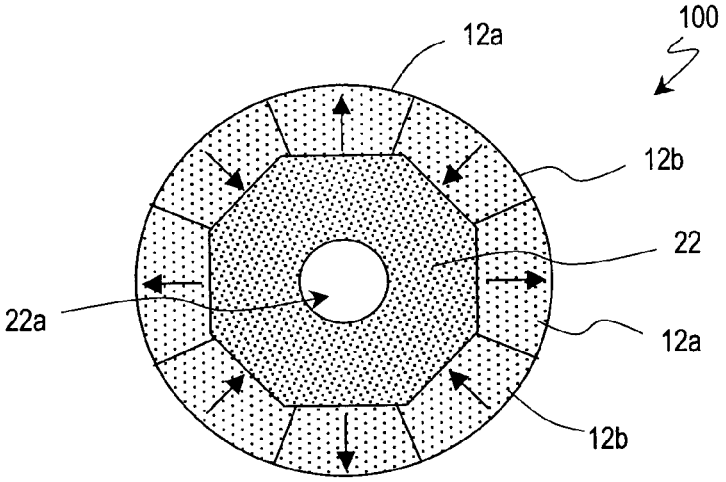
FIG. 7 is a schematic representation illustrating the structure of the rotor 100 obtained by a manufacturing process according to a preferred embodiment of the present invention.

According to the manufacturing process of the present invention, the magnitude of deformation (i.e., a variation in volume) in the integrating process step becomes 30% or less, thus contributing to making a magnetic circuit component with high size accuracy. After a number of porous magnets 12*a*', 12*b*' and a green compact 22' of the soft magnetic material powder have been prepared as described above, the porous magnets 12*a*', 12*b*' and green compact 22' of the soft magnetic material powder are put in place in a die as shown in FIG. 6(*c*), and subjected to a hot press compaction. As a result of this hot pressing, the porous magnets 12*a*', 12*b*' are compressed to turn into magnet compacts 12*a*, 12*b* with an increased density. In this manner, a rotor (an example of magnetic circuit component) 100, in which a number of magnet compacts 12*a*, 12*b* and a compact 22 of the soft magnetic material powder are assembled together as shown in FIG. 7, can be obtained.

In this hot press compaction process, the pressure applied is preferably 20 MPa to 500 MPa. This is because if the pressure were short of this range, the bond strength between the magnet parts and the compact of the soft magnetic material powder might be insufficient. On the other hand, if the pressure were beyond this range, the press machine itself could be deformed as a result of the hot pressing process. Nevertheless, if huge equipment were introduced to avoid the deformation, then the manufacturing cost would increase. The compacting temperature is preferably 400° C. to less than 1,000° C., more preferably 600° C. to 900° C., and even more preferably 700° C. to 800° C. This temperature range is preferred for the following reasons. Specifically, if the compacting temperature were lower than 400° C., the densities of the magnet compacts and green compact of the soft magnetic material powder could not be increased sufficiently. On the other hand, if the compacting temperature were equal to or higher than 1,000° C., the crystal grains would grow so much as to cause deterioration in the magnetic properties of the anisotropic magnet powder. Also, the period of time to keep the temperature and the pressure specified above (which will be referred to herein as a "compaction process time") is preferably 10 seconds to one hour, more preferably as short as one to ten minutes from the standpoint of productivity. Naturally, the compaction process time is appropriately set according to the combination of the compacting temperature and the compacting pressure. However, if the compaction process time were shorter than 10 seconds, the density of the compacts could not be increased sufficiently. Meanwhile, if the compaction process time were longer than one hour, the crystal grains might grow too much to keep good magnetic properties. Also, to prevent the rare-earth magnet powder from being oxidized, the hot pressing process is preferably carried out in an inert atmosphere (which may also be a rare gas or nitrogen gas).

In the rotor 100 thus obtained, the density of the magnet compacts 12*a*, 12*b* is approximately 95% of their true density and that of the compact 22 of the soft magnetic material powder is also approximately 95% or more of its true density. In the example described above, a green compact 22' of a soft magnetic material powder is made in advance separately from the porous magnets 12*a*', 12*b*' and then the compact and magnets are subjected to the hot pressing process, thereby integrating them together. Alternatively, without making the green compact 22' of the soft magnetic material powder in advance, the porous magnets 12*a*', 12*b*' and the soft magnetic material powder yet to be compacted may be assembled together by subjecting them to the hot press compaction. Nevertheless, to obtain a magnetic circuit component with high size accuracy, the process described above, in which a green compact of the soft magnetic material powder and porous magnets are made beforehand and then assembled together, is preferred.

EXAMPLES

Example #1

An alloy with a composition such as that shown in the following Table 1 (of which the target composition was $Nd_{13.65}Fe_{bal}Co_{16}B_{6.5}Ga_{0.5}Zr_{0.09}$ (where subscripts indicate atomic percentages)) was provided to make a porous rare-earth permanent magnet by the manufacturing process that has been described above for preferred embodiments of the present invention. In Table 1, the unit of the numerical values is mass %. Hereinafter, a method for producing a magnet according to a first specific example of the present invention will be described.

TABLE 1

| Alloy | Nd | Pr | Fe | Co | B | Ga | Zr |
|---|---|---|---|---|---|---|---|
| A | 29.7 | 0.1 | Balance | 14.3 | 1.06 | 0.50 | 0.13 |

First, a rapidly solidified alloy having the composition shown in Table 1 was made by a strip casting process. The rapidly solidified alloy thus obtained was coarsely pulverized by a hydrogen occlusion decrepitation process into a powder with particle sizes of 425 μm or less, and then the coarse powder was finely pulverized with a jet mill, thereby obtaining a fine powder with a mean particle size of 4.4 μm. As used herein, the "mean particle size" refers to a 50% volume center particle size ($D_{50}$) obtained by Laser Diffraction Particle Size Analyzer (HEROS/RODOS produced by Sympatec GmbH).

This fine powder was loaded into the die of a press machine. And under a magnetic field of 1.5 tesla (T), a pressure of 20 MPa was applied to the fine powder perpendicularly to the magnetic field, thereby making a powder compact. The density of the powder compact was calculated 4.19 g/cm$^3$ based on the dimensions and weight.

Next, the powder compact was subjected to the HDDR process described above. Specifically, the powder compact was heated to 840° C. within an argon gas flow at 100 kPa (i.e., at the atmospheric pressure). After the atmospheres were changed into a hydrogen gas flow at 100 kPa (i.e., at the atmospheric pressure), the powder compact was maintained at 840° C. for two hours, thereby producing hydrogenation and disproportionation reactions. Thereafter, the powder compact was maintained at 840° C. for one more hour within an argon gas flow at a reduced pressure of 5.3 kPa to produce hydrogen desorption and recombination reactions. And then the temperature was decreased to room temperature within an Ar gas flow at the atmospheric pressure to obtain a sample representing a specific example of the present invention.

The dimensions of the sample thus obtained were measured and compared to those measured before the heating process. The shrinkage rates of the sample were calculated in the magnetic field direction and in the die pressing direction and the shrinkage ratio was calculated 1.39. In this case, the shrinkage rate (%) is given by (size of sample yet to be heated−size of heated sample)÷size of sample yet to be heated×100, while the shrinkage ratio is given by (shrinkage rate in magnetic field direction/shrinkage rate in die pressing direction).

The concentration of oxygen in the sample that had just been subjected to the DR process was 0.45 mass % and the content of extra rare-earth element R' was calculated 0.76 at % based on Nd, Pr, Fe and Co shown in Table 1.

Figure 8:
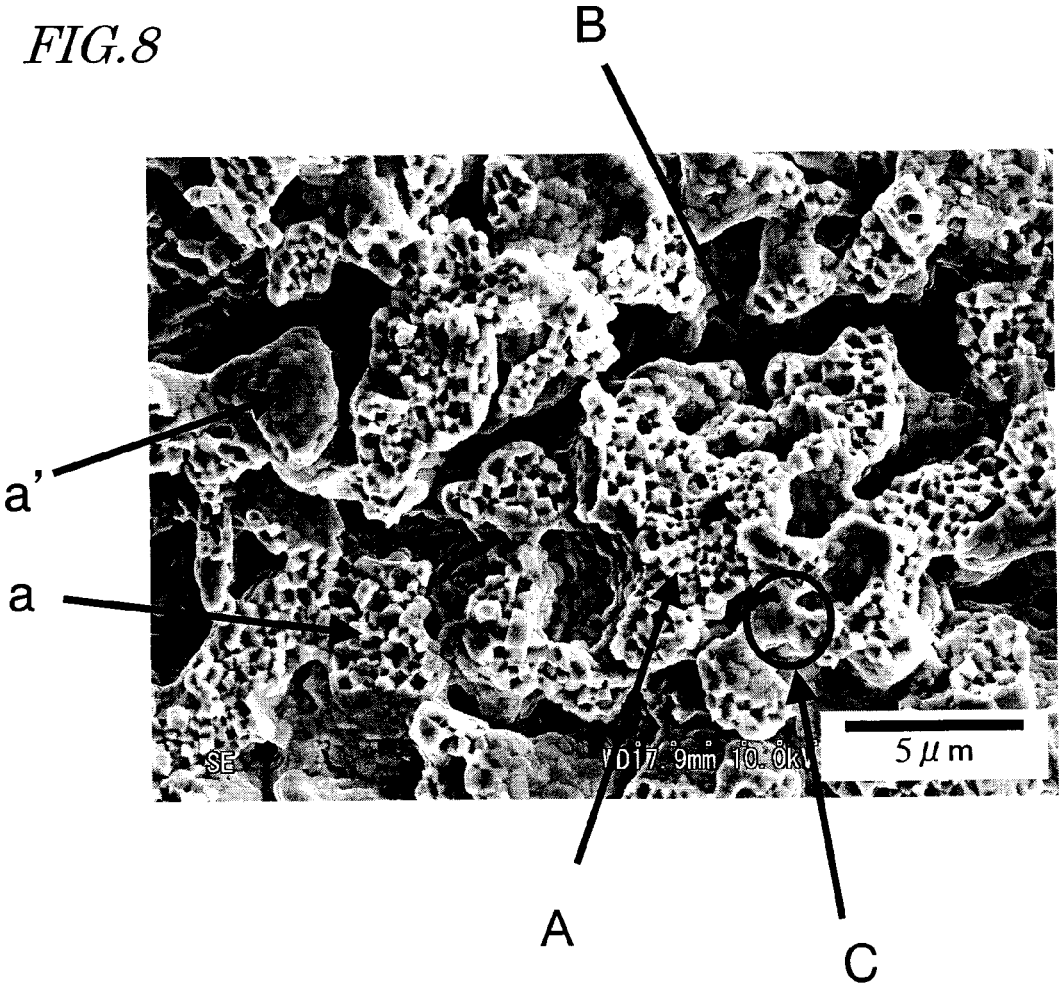
FIG. 8 is another SEM photograph showing a fractured face of a porous magnet representing a specific example of the present invention.

A face of the sample perpendicular to the magnetic field application direction was analyzed with an X-ray diffraction analyzer. As a result, it was confirmed that the sample had an $Nd_2Fe_{14}B$ phase and that its easy magnetization axis was aligned with the magnetic field direction. Also, a fractured face of the sample was observed with a scanning electron microscope (SEM). FIG. 8 is an SEM photograph showing the fractured face of the sample. FIG. 8 is different from FIG. 1 in zoom power. Powder particles A that had been bonded together and gaps B between the powder particles A (i.e., micropores with a major axis of 1 μm to 20 μm) are also shown in FIG. 8. Each of the powder particles A had an aggregate structure of $Nd_2Fe_{14}B$ type crystalline phases with an average grain size of 0.1 μm to 1 μm. The powder particles A shown in FIG. 8 correspond to the powder particles A1 and A2 schematically shown in FIG. 3(*b*) and the gaps B shown in FIG. 8 correspond to the gaps B shown in FIG. 3(*b*). Also, the region C shown in FIG. 8 corresponds to the bonding portion C between particles shown in FIG. 3(*b*).

As can be seen easily from FIG. 8, the magnet of this specific example had a porous structure in which pores with sizes of 1 μm to 20 μm were dispersed. Such a porous structure was formed by sintering powder particles with a mean particle size that was less than 10 μm. However, unlike a normal sintered magnet, the porous structure had not have its density increased and had a low density. Such a structure is obtained by performing the HDDR process at a temperature that is sufficiently lower than a normal sintering temperature of approximately 1,100° C. If the DR process were performed at a high temperature of 1,000° C. to 1,150° C., the sintered body would have an increased density and no porous magnets could be obtained. On top of that, if the DR process were performed at such a high temperature, the crystal grains would grow extraordinarily and the magnet's performance would be highly likely to deteriorate.

In the sample of this specific example, the HDDR process advances during the sintering process unlike a normal sintered magnet. As a result, an aggregate structure consisting of very fine crystalline phases with sizes of 0.1 μm to 1 μm is formed inside each powder particle.

Also, the aggregate structure forming the powder particles shown in FIG. 8 was seen to include portions consisting of relatively rugged very small crystals (as in the region a) and portions consisting of relatively round very small crystals (as in the region a'). Comparing this appearance to that of a conventional HDDR magnetic powder as disclosed in Patent Document No. 1, it can be seen that those relatively round very small crystals as in the region a' have a similar appearance to the surface of respective powder particles of the conventional HDDR magnetic powder when the powder particles are not pulverized yet after the HDDR process. On the other hand, it can also be seen that those relatively rugged very small crystals as in the region a have a similar appearance to the fractured face of respective powder particles of the conventional HDDR magnetic powder when the powder particles are pulverized after the HDDR process. Taking these points into consideration, it can be seen that the region a shown in FIG. 8 shows how a fractured face (i.e., the inside) of respective powder particles that have been bonded together by the HDDR process looks after the HDDR process. It can also be seen that the region a' shown in FIG. 8 shows how the surface of respective powder particles that form the powder compact looks after the HDDR process. The appearance including two types of very small crystals such as those observed in the regions a and a' is one of the features of a porous magnet made by the process of the present invention (i.e., by subjecting a powder compact of a fine powder to the HDDR process).

Figure 9:
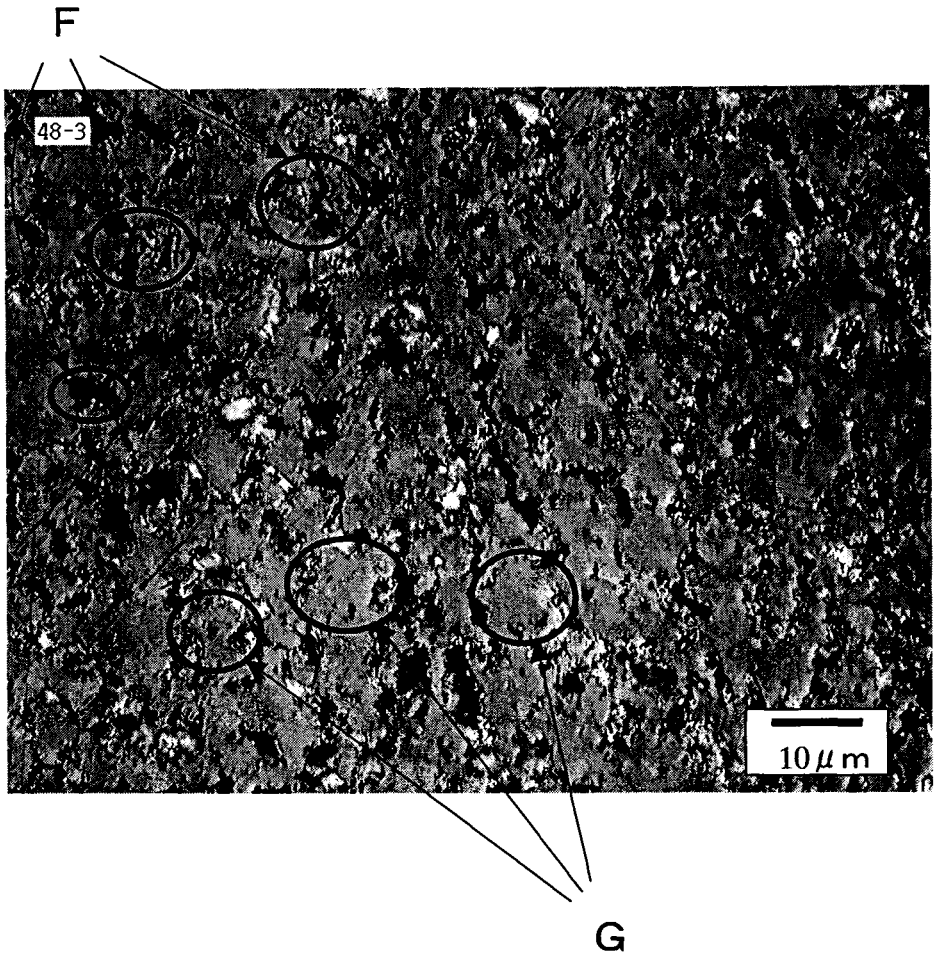
FIG. 9 is a Kerr effect micrograph showing a polished surface of a porous magnet representing a specific example of the present invention.

Next, the surface of the sample was ground with a surface grinder and worked into a prism shape with dimensions of 10 mm×11 mm×12 mm. FIG. 9 is a Kerr effect micrograph showing a polished surface, where encircled portions F indicate some of the gaps that appeared on the polished surface. It can be seen that the gaps had a major axis of about 1 μm to about 20 μm. In FIG. 9, the encircled portions G indicate hard magnetic phases.

It should be noted that the sample never cracked nor chipped even after the grinding and polishing process.

Based on the dimensions and weight of the sample, the density of the sample was calculated 5.46 g/cm$^3$. The sample that had been subjected to the grinding process was magnetized with a pulse magnetic field of 3.2 MA/m and then its magnetic properties were measured with a BH tracer MTR-1412 (produced by Metron, Inc.) The results are shown in the following Table 2:

TABLE 2

| Alloy | $J_{max}$ (T) | $B_r$ (T) | $H_{cB}$ (kA/m) | $(BH)_{max}$ (kJ/m$^3$) | $H_{cJ}$ (kA/m) | $H_k$ (kA/m) | $H_k/H_{cJ}$ |
|---|---|---|---|---|---|---|---|
| A | 0.94 | 0.92 | 640 | 159 | 887 | 614 | 0.69 |

In Table 2, $J_{max}$ is the maximum value of magnetization J (T) of the magnetized sample when an external magnetic field H of up to 2 tesla (T) was applied to the sample in the magnetization direction, and $H_k$ is a value of the external magnetic field H when $B_r \times 0.9$. The greater the $H_k/H_{cJ}$ ratio, the better the loop squareness of the demagnetization curve.

Figure 10:
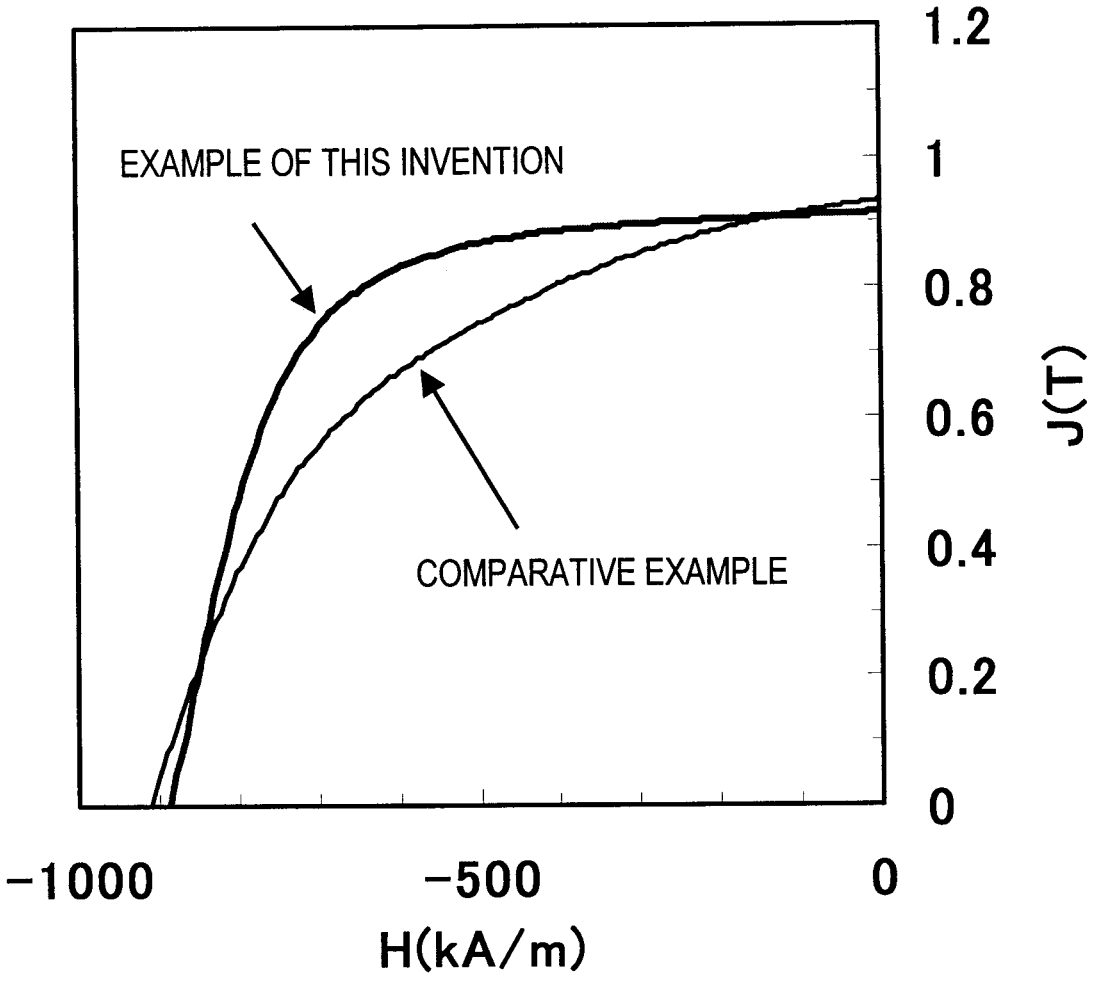
FIG. 10 is a graph showing the demagnetization curves (which are respective second quadrants of hysteresis curves) of a specific example of a porous magnet according to the present invention and a comparative example.

FIG. 10 is a graph showing the demagnetization curves of this specific example of the present invention and a comparative example. In FIG. 10, the ordinate represents the magnetization J and the abscissa represents the external magnetic field H. The comparative example shown in FIG. 10 is the demagnetization curve of a bonded magnet (with a density of 5.9 g/cm$^3$), which was obtained by subjecting an HDDR magnetic powder with a mean particle size of about 70 μm to a conventional manufacturing process and which had similar $B_r$ and $H_{cJ}$ to those of the specific example. This bonded magnet had a $(BH)_{max}$ of 143 kJ/m$^3$ and an $H_k/H_{cJ}$ ratio of 0.36. As can be seen easily from FIG. 10, the specific example of the present invention showed better loop squareness of demagnetization curve, and achieved higher $(BH)_{max}$, than the comparative example.

Example #2

Next, the porous magnet of the first specific example of the present invention described above was pulverized with a mortar within an argon atmosphere and then classified, thereby obtaining a powder with particle sizes of 75 μm to 300 μm. Then, this powder was loaded into a cylindrical holder and fixed with paraffin while being aligned with a magnetic field of 800 kA/m. The sample thus obtained was magnetized with a pulse magnetic field of 4.8 MA/m and then its magnetic properties were measured with a vibrating sample magnetometer (VSM) (e.g., VSM5 produced by Toei Industry Co., Ltd.). It should be noted that no anti-magnetic field correction was made. The results are shown in the following Table 3:

TABLE 3

| Alloy | $J_{max}$ (T) | $B_r$ (T) | $H_{cB}$ (kA/m) | $(BH)_{max}$ (kJ/m$^3$) | $H_{cJ}$ (kA/m) | $H_k$ (kA/m) |
|---|---|---|---|---|---|---|
| A | 1.16 | 1.14 | 595 | 203 | 864 | 338 |

In Table 3, $J_{max}$ and $B_r$ were calculated on the supposition that the sample had a true density of 7.6 g/cm$^3$. It should be noted that $J_{max}$ is a value obtained by correcting the magnetization J (T) of the sample, which was measured when an external magnetic field H of 2 tesla (T) was applied to the magnetized sample in its magnetization direction, in view of the mirror image effect of the VSM measurements. As can be seen from Table 3, the magnet powder obtained by pulverizing the porous sintered magnet also exhibited good magnetic properties. Such a magnet powder can be used effectively to make a bonded magnet.

The results of measurements and observations that have been described for specific examples of the present invention reveal that the porous magnet of the present invention has good loop squareness in demagnetization curve. In addition, the magnet of the present invention shows a little shrinkage anisotropy of 1.39 during the heating process (whereas a normal sintered magnet has a shrinkage anisotropy of two or more). Besides, the magnet of the present invention has such high strength as to be machined with no problem and may also be used as a bulk magnet body as it is even without being impregnated with a resin. Furthermore, even if the porous magnet of the present invention is pulverized into a powder, the coercivity $H_{cJ}$ thereof does not decrease so much and can be used as a magnetic powder to make a bonded magnet.

Example #3

In a third specific example of the present invention, a full-dense magnet was produced by increasing the density of the porous magnet of the first specific example of the present invention using the hot press machine shown in FIG. 4. More specifically, the porous magnet of the first specific example was prepared, subjected to a grinding process, and then put in place in a carbon dice. Then this dice was loaded into the hot press machine and compressed at 700° C. in a vacuum under a pressure of 50 MPa.

After the hot pressing process, the full-dense magnet had a density of 7.58 g/cm$^3$. The magnetic properties of this full-dense magnet were measured with a BH tracer (MTR-1412 produced by Metron, Inc.) The results are shown in the following Table 4. $J_{max}$ is the maximum value of magnetization J (T) of the magnetized sample when an external magnetic field H of up to 2 tesla (T) was applied to the sample in the magnetization direction.

TABLE 4

| Alloy | $J_{max}$ (T) | $B_r$ (T) | $(BH)_{max}$ (kJ/m$^3$) | $H_{cJ}$ (kA/m) | $H_k$ (kA/m) |
|---|---|---|---|---|---|
| A | 1.32 | 1.30 | 295 | 872 | 612 |

As can be seen from these results, when the manufacturing process of the present invention was adopted, a porous magnet that showed good loop squareness in its demagnetization curve and that had a little shrinkage anisotropy of 1.39 (whereas a normal sintered magnet would have a shrinkage anisotropy of two or more) during the heating process could be obtained. In addition, this porous magnet had strength that was high enough to go through a machining process with no problem. Furthermore, this porous magnet had crystal grains, of which the size was smaller than that of crystal grains of a sintered magnet by more than one digit, and therefore, showed little deterioration in magnetic properties due to surface degradation even when worked into a thin shape. Besides, the density of this magnet can be increased easily by a heating and compressing process such as hot pressing or hot rolling.

In this manner, by increasing the density of the porous magnet of the present invention by heating and compressing it, the following beneficial effects that could not be produced by the prior art will be achieved:

(1) Since a material powder with a mean particle size of 10 μm or less is used, the magnetic powder particles contact with each other in a broader area than the situation where the conventional HDDR magnetic powder is used. That is why even a powder compact with a relatively low density can be handled easily, thus making it possible to reduce the compacting pressure to make a green compact and achieving high mass productivity on an industrial basis. In addition, with the density of the powder compact decreased, the non-uniformity in orientations that would be caused when the powder compact has an increased density can be minimized;

(2) The magnetic powder yet to be subjected to the HDDR process has low coercivity. For that reason, if a powder compact is obtained by compacting such a magnetic powder under a magnetic field, the powder compact can be demagnetized easily. Also, since the powder compact is perfectly demagnetized as a result of the HDDR process, the powder compact is easy to handle when heated and compressed (i.e., subjected to hot working);

(3) The porous magnet obtained through the HDDR reactions has strength that is high enough to go through a machining process with no problem. That is why the porous magnet does not always have to be put into a dice when heated and compressed although it is necessary to do that in making a full-dense magnet out of a conventional HDDR powder. In addition, since the porous magnet has already been aligned completely, there is no need to align the magnet with a magnetic field in the die just before the magnet is heated and compressed or to produce anisotropy by subjecting the magnet to hot plastic working. As a result, the magnet will achieve high mass productivity on an industrial basis, better magnetic properties, and more flexibility in design;

(4) The porous magnet for use in the present invention shows better loop squareness than the conventional HDDR magnetic powder, and can maintain it even after having been heated and compressed to have its density increased fully; and (5) Even if more anisotropy needs to be produced by hot plastic working during the heating and compression process, a magnet with higher anisotropy than what is made of a conventional magnetic powder can be obtained with high productivity.

Example #4

First, porous magnets 12*a*', 12*b*' were made by the same method as that already described for the first specific example of the present invention. In this specific example, these porous magnets 12*a*', 12*b*' and an iron core green compact 22' are subjected to a hot press compaction as shown in FIGS. 11(*a*) through 11(*d*).

Figure 11:
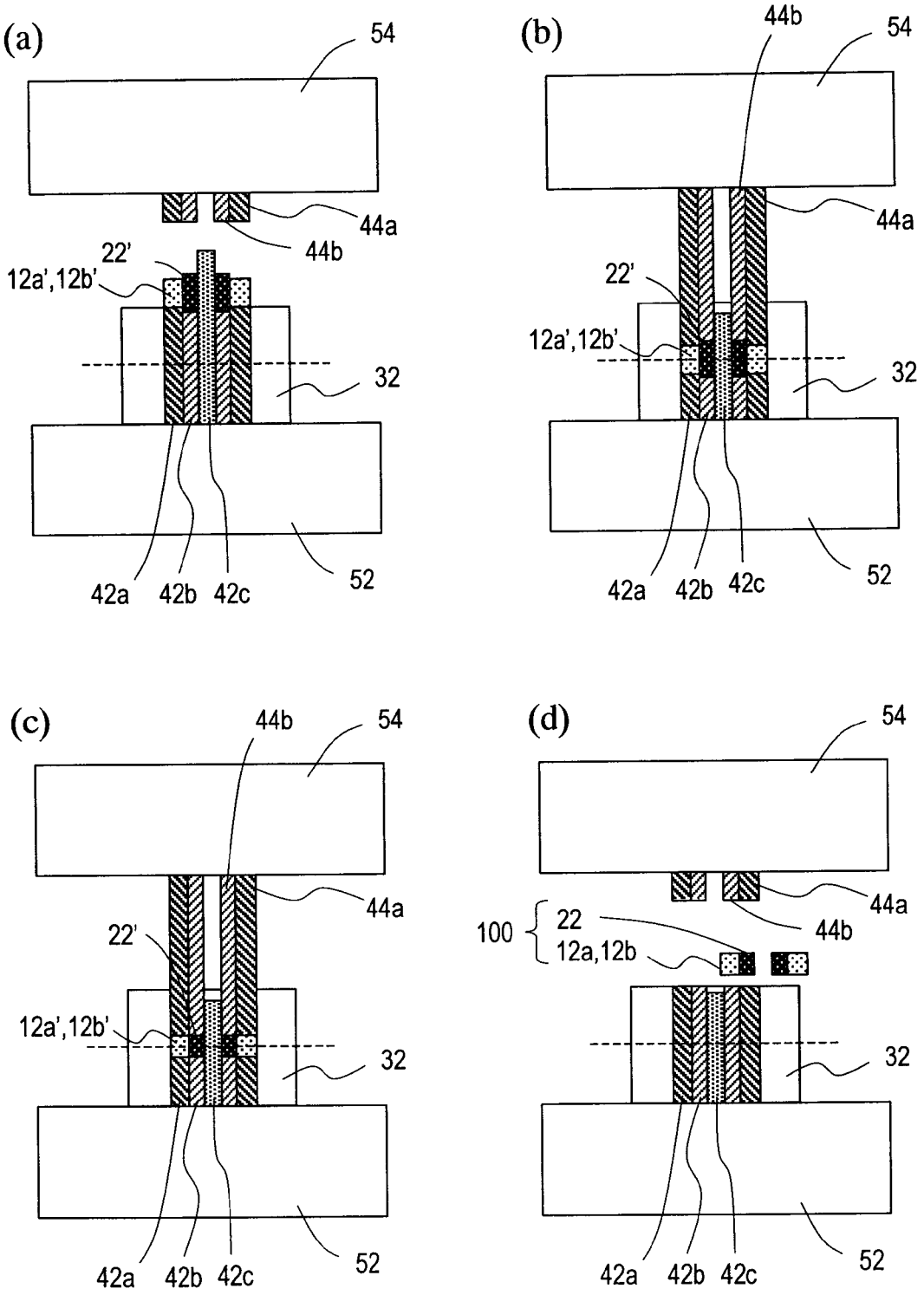
FIGS. 11(*a*) through 11(*d*) are schematic cross-sectional views illustrating a hot press forming process step of the manufacturing process of a rotor 100 according to a preferred embodiment of the present invention.

The hot pressing machine shown in FIG. 11(*a*) includes a die 32 with a hole that can form a cavity in a predetermined shape, lower punches 42*a* and 42*b* that can move within the hole of the die 32, a center shaft 42*c*, a lower ram 52 that supports these members and that can move up and down when necessary, upper punches 44*a* and 44*b* that can move within the hole of the die 32, and an upper ram 54 that supports these members and that can move up and down when necessary. The lower and upper punches 42*a* and 44*a* are used to press the porous magnets 12*a*', 12*b*', while the lower and upper punches 42*b* and 44*b* are used to press the iron core green compact 22'. It is preferable to perform appropriate types of press compaction processes on the respective compacts in this manner using a press machine that can press the porous magnets 12*a*', 12*b*' and the iron core green compact 22' independently of each other (which is sometimes called a "multi-axis press machine"). This is because the difference in the magnitude of compression deformation between the respective green compacts, which is significant at an initial stage of the compression process, can be narrowed. Although not shown in FIG. 11, the hot pressing machine further includes a heater that heats the lower ram 52, the die 32, the upper and lower punches 42*a*, 42*b*, 44*a* and 44*b* and the center shaft 42*c* to a predetermined temperature.

First, as shown in FIG. 11(*a*), the porous magnets 12*a*', 12*b*' and the iron core green compact 22' are assembled together at a predetermined position on the die 32. In this example, the porous magnets 12*a*', 12*b*' and the iron core green compact 22' are assembled together as shown in FIG. 6(*c*) so that the center shaft 42*c* runs through the hole 22*a*' of the iron core green compact.

Next, as shown in FIG. 11(*b*), the lower punches 42*a*, 42*b* and the upper punches 44*a*, 44*b* are moved up and down, thereby inserting the assembly of the porous magnets 12*a*', 12*b*' and the iron core green compact 22' into the cavity that has been formed in the die 32. Thereafter, the temperature of the cavity is maintained at approximately 800° C., for example.

Subsequently, as shown in FIG. 11(*c*), the lower punches 42*a*, 42*b* and the upper punches 44*a*, 44*b* are moved up and down, thereby pressing the porous magnets 12*a*', 12*b*' and the iron core green compact 22'. In this process step, a pressure of 2 ton/cm$^2$ is applied for five minutes.

Then, as shown in FIG. 11(*d*), the lower punches 42*a*, 42*b* and the upper punches 44*a*, 44*b* are moved up and down again to unload a rotor 100, in which magnet parts 12*a*, 12*b* and an iron core (soft magnetic part) 22 have been assembled together, from the die 32.

Thereafter, the temperature is decreased to room temperature to obtain the rotor 100. There is no need to perform a sintering process after that.

The magnet parts 12*a*, 12*b* that were made as samples by the manufacturing process described above had a density of 7.4 g/cm$^3$, which was 97.4% of their true density (of 7.6 g/cm$^3$) and was approximately as high as that of a normal sintered magnet. On the other hand, the iron core 22 had a density of 7.7 g/cm$^3$, which was 98.7% of its true density (of 7.8 g/cm$^3$).

The sample rotor was never broken even at a rotational frequency of 33,000 rpm and had sufficiently high bond strength. Specifically, as a result of a shear test, the bond strength between the magnet parts 12*a*, 12*b* and the iron core 22 was 57 MPa and a surface flux density of 0.42 T was achieved.

To further increase the mass productivity, the following process may also be performed.

Specifically, first, the assembling process step shown in FIG. 11(*a*) may be performed in a set of a die and punches, which is provided separately from the hot pressing machine, and the magnets and iron core may be preheated to such a temperature as producing no crystal growth (e.g., approximately 600° C.). When a predetermined temperature is reached, that set of die and punches is moved to the hot pressing machine, where the magnets and core are heated to the best temperature (e.g., 800° C.) in a short time by an induction heating process or an electric heating process, and then pressed and assembled together for a short time. Optionally, if a number of such die/punch sets are prepared and if the series of process steps from preheating through integrating pressing are carried out continuously by using a pressure furnace, for example, within a reduced pressure atmosphere or an inert atmosphere, the productivity can be further increased.

Example #5

First, the same porous material as the porous magnet of the first specific example of the present invention described above is prepared. Next, the porous material was machined into the dimensions of 7 mm×7 mm×5 mm with an outer blade cutter and a grinding machine. As a result of this machining, the porous material never cracked or chipped. Subsequently, the porous material was ultrasonic cleaned and then immersed in a nanoparticle dispersed colloidal solution, in which Co nanoparticles with a mean particle size of about 10 μm were dispersed and of which the solvent was tetradecane and the solid matter concentration was 60 mass %. The nanoparticle dispersed colloidal solution was put into a glass container, which was then loaded into a vacuum desiccator with the porous material immersed in the solution and put under a reduced pressure. During this process, the atmospheric gas pressure was adjusted to about 130 Pa.

Due to the reduced pressure, bubbles were produced in the porous material and in the nanoparticle dispersed colloidal solution. And when the bubbles were no longer produced, the pressure was once raised to the atmospheric pressure. Thereafter, the porous material was inserted into a vacuum dryer and then heated to 200° C. under an atmospheric gas pressure of about 130 Pa, thereby vaporizing the solvent and drying the material. In this manner, a sample of a composite bulk material according to the present invention was obtained.

The composite bulk material obtained by the process described above was put into a hot pressing machine and compressed at 700° C. and under a pressure of 50 MPa in a vacuum. After the hot pressing process, the resultant full-dense composite bulk magnet had a density of 7.73 g/cm$^3$.

Then, the sample of this specific example was magnetized with a pulse magnetic field of 3.2 MA/m and then its magnetic properties were measured with a BH tracer MTR-1412 (produced by Metron, Inc.) The results are shown in the following Table 5:

TABLE 5

| Magnetic properties | $B_r$ (T) | $(BH)_{max}$ (kJ/m$^3$) | $H_{cJ}$ (kA/m) |
|---|---|---|---|
| Composite bulk magnet | 1.34 | 318 | 820 |

In this specific example, the porous material was entirely immersed in the nanoparticle dispersed colloidal solution. However, since the solution can penetrate deep into the porous magnet material through the capillarity phenomenon, just a part of the porous material may be immersed in the nanoparticle dispersed colloidal solution.

Reference Example

First, a porous material was prepared by the same method as of the first specific example of the present invention described above. In this reference example, however, the porous material was not subjected to the impregnation process but directly processed by a hot compaction process to make a full-dense magnet, and its properties were evaluated. Specifically, the porous material obtained by the process described above was put into a hot pressing machine and compressed at 700° C. and under a pressure of 50 MPa in a vacuum. After the hot pressing process, the resultant full-dense magnet had a density of 7.58 g/cm$^3$. Then, the full-dense magnet was magnetized with a pulse magnetic field of 3.2 MA/m and then its magnetic properties were measured with a BH tracer MTR-1412 (produced by Metron, Inc.) The results are shown in the following Table 6:

TABLE 6

| Magnetic properties | $B_r$ (T) | $(BH)_{max}$ (kJ/m$^3$) | $H_{cJ}$ (kA/m) |
|---|---|---|---|
| Full-dense magnet | 1.30 | 295 | 872 |

As can be seen from these results, the composite bulk magnet (which will be simply referred to herein as a "composite magnet") made by the method of the present invention had an increased remanence $B_r$ compared to the magnet of this reference example that had its density increased fully by a hot compaction process without subjecting the porous material to any impregnation process. The present inventors also confirmed that in the specific example of the present invention, the demagnetization curve in the easy magnetization direction had no inflection point and that the composite bulk magnet acted as a composite magnet including a hard magnetic phase ($Nd_2Fe_{14}B$ type compound) and a soft magnetic phase (metallic nanoparticles) in combination.

Example #6

First, the same porous material as the porous magnet of the first specific example of the present invention described above is prepared. Next, the porous material was machined into the dimensions of 20 mm×20 mm×20 mm with an outer blade cutter and a grinding machine. As a result of this machining, the porous material never cracked or chipped. Subsequently, the porous material was ultrasonic cleaned and then immersed in a $DyF_3$ fine particle dispersed solution, in which $DyF_3$ fine particles with particle sizes of 0.05 μm to 0.5 μm were dispersed in dodecane. The $DyF_3$ fine particle dispersed solution was put into a glass container, which was then loaded into a vacuum desiccator with the porous material immersed in the solution and put under a reduced pressure. During this process, the atmospheric gas pressure was adjusted to about 130 Pa.

Due to the reduced pressure, bubbles were produced in the porous material and in the $DyF_3$ fine particle dispersed solution. And when the bubbles were no longer produced, the pressure was once raised to the atmospheric pressure. Thereafter, the porous material was inserted into a vacuum dryer and then heated to 200° C. under an atmospheric gas pressure of about 130 Pa, thereby vaporizing the solvent and drying the material. In this manner, a sample of a composite bulk material according to the present invention was obtained.

The composite bulk material obtained by the process described above was put into a hot pressing machine and compressed at 700° C. and under a pressure of 50 MPa in a vacuum. After the hot pressing process, the resultant full-dense composite bulk magnet had a density of 7.55 g/cm$^3$.

Thereafter, the full-dense composite bulk magnet thus obtained was heated at 800° C. for three hours and then cooled.

Then, the sample of this specific example was magnetized with a pulse magnetic field of 3.2 MA/m and then its magnetic properties were measured with a BH tracer MTR-1412 (produced by Metron, Inc.) The results are shown in the following Table 7:

TABLE 7

| Magnetic properties | $B_r$ (T) | $(BH)_{max}$ (kJ/m$^3$) | $H_{cJ}$ (kA/m) |
|---|---|---|---|
| Composite bulk magnet | 1.28 | 285 | 1,216 |

In this specific example, the porous material was entirely immersed in the $DyF_3$ fine particle dispersed solution. However, since the solution can penetrate deep into the porous magnet material through the capillarity phenomenon, just a part of the porous material may be immersed in the $DyF_3$ fine particle dispersed solution.

As can be seen from these results, the composite bulk magnet made by the method of the present invention had an increased coercivity $H_{cJ}$ compared to the magnet of the reference example that had its density increased fully by a hot compaction process without subjecting the porous material to any impregnation process.

Example #7

Rapidly solidified alloys B through F, of which the target compositions are shown in the following Table 8, were made by a strip casting process. The rapidly solidified alloys thus obtained were coarsely pulverized, finely pulverized and then compacted under a magnetic field by the same methods as those already described for the first specific example, thereby obtaining powder compacts with densities of 4.18 g/cm$^3$ to 4.22 g/cm$^3$. The mean particle sizes of the fine powders are also shown in the following Table 8 and were measured by the same method as that of the first specific example (with the 50% center particle size ($D_{50}$) regarded as the mean particle size).

TABLE 8

| Alloy | Target composition (at %) | $D_{50}$ of fine powder (μm) | HD process temperature and process time |
|---|---|---|---|
| B | $Nd_{13.65}Fe_{bal}B_{6.5}$ | 4.18 | 890° C. × 30 min. |
| C | $Nd_{13.65}Fe_{bal}Co_8B_{6.5}$ | 4.32 | 860° C. × 30 min. |
| D | $Nd_{15.3}Dy_{0.6}Fe_{bal}Co_8B_{6.2}Ga_{0.5}$ | 4.27 | 840° C. × 2 hr. |
| E | $Nd_{15.90}Fe_{bal}Co_3Ni_1B_{6.2}Ga_{0.1}$ | 4.31 | 860° C. × 30 min. |
| F | $Nd_{15.90}Fe_{bal}Co_3B_{6.2}C_{0.2}Ga_{0.1}Cu_{0.1}$ | 4.19 | 860° C. × 30 min. |

Next, the powder compacts were subjected to the HDDR process described above. Specifically, the powder compacts were heated to the HD temperatures shown in Table 8 within an argon gas flow at 100 kPa (i.e., at the atmospheric pressure). After the atmospheres were changed into a hydrogen gas flow at 100 kPa (i.e., at the atmospheric pressure), the powder compacts were maintained at the temperatures and for the periods of time that are shown in Table 8, thereby producing hydrogenation and disproportionation reactions. Thereafter, the powder compacts were maintained at the HD temperatures shown in Table 8 for one more hour within an argon gas flow at a reduced pressure of 5.3 kPa to produce hydrogen desorption and recombination reactions. And then the temperature was decreased to room temperature within an Ar gas flow at the atmospheric pressure to obtain samples representing specific examples of the present invention. The present inventors confirmed that the fractured face of each of these samples obtained consisted of an aggregate structure of very small crystals and micropores that had similar appearance to that shown in the photograph of FIG. 1.

Next, the surface of the samples was worked with a surface grinder and the densities of the samples were calculated based on the dimensions and weight thereof after the grinding process. The results are shown in the following Table 9. The present inventors confirmed that each of these samples had sufficiently high mechanical strength because the magnet never cracked even after the grinding process. The samples that had been subjected to the grinding process were magnetized with a pulse magnetic field of 3.2 MA/m and then their magnetic properties were measured with a BH tracer MTR-1412 (produced by Metron, Inc.) The results are shown in the following Table 9. In Table 10, $J_{max}$ is the maximum value of magnetization J (T) of the magnetized sample when an external magnetic field H of up to 2 tesla (T) was applied to the sample in the magnetization direction and $H_k$ is a value of the external magnetic field H when $B_r \times 0.9$ as in the first specific example described above.

TABLE 9

| Alloy | Density (g/cm$^3$) | $B_r$ (T) | $H_{cJ}$ (kA/m) | $(BH)_{max}$ (kJ/m$^3$) | $B_r/J_{max}$ | $H_k/H_{cJ}$ |
|---|---|---|---|---|---|---|
| B | 5.93 | 1.08 | 285 | 155 | 0.98 | 0.89 |
| C | 5.22 | 0.92 | 325 | 150 | 0.98 | 0.92 |
| D | 5.88 | 0.85 | 1,283 | 131 | 0.95 | 0.57 |
| E | 6.18 | 0.96 | 815 | 155 | 0.96 | 0.51 |
| F | 5.93 | 0.96 | 865 | 173 | 0.97 | 0.62 |

Based on the results of this specific example, the present inventors confirmed that a porous magnet with good loop squareness, which is one of the effects of the present invention, could be obtained no matter which of these R—Fe-Q alloy compositions was adopted and that the same effect was also achieved even when Fe was partially replaced with Co and/or Ni.

Example #8

Rapidly solidified alloys G through L, of which the target compositions are shown in the following Table 10, were made by a strip casting process. The rapidly solidified alloys thus obtained were coarsely pulverized, finely pulverized and then compacted under a magnetic field by the same methods as those already described for the first specific example, thereby obtaining powder compacts with densities of 4.18 g/cm$^3$ to 4.22 g/cm$^3$. The mean particle sizes of the fine powders are also shown in the following Table 10 and were measured by the same method as that of the first specific example (with the 50% center particle size ($D_{50}$) regarded as the mean particle size).

TABLE 10

| Alloy | Target composition (at %) | $D_{50}$ of fine powder (μm) |
|---|---|---|
| G | $Nd_{15.90}Fe_{bal}Co_1B_{6.2}Ga_{0.1}$ | 4.14 |
| H | $Nd_{15.90}Fe_{bal}Co_3B_{6.2}Ga_{0.1}$ | 4.27 |
| I | $Nd_{15.90}Fe_{bal}Co_3B_{6.2}Ga_{0.1}Al_{0.5}$ | 3.97 |
| J | $Nd_{15.90}Fe_{bal}Co_3B_{6.2}Ga_{0.1}Cu_{0.5}$ | 4.10 |
| K | $Nd_{15.90}Fe_{bal}Co_3B_{6.2}Ga_{0.1}Zr_{0.5}$ | 4.17 |
| L | $Nd_{15.90}Fe_{bal}Co_3B_{6.2}Ga_{0.1}Nb_{0.3}$ | 4.22 |

Next, the powder compacts were subjected to the HDDR process described above. Specifically, the powder compacts were heated to 860° C. within an argon gas flow at 100 kPa (that is the atmospheric pressure). After the atmospheres were changed into a hydrogen gas flow at 100 kPa (that is the atmospheric pressure), the powder compacts were maintained at 860° C. for 30 minutes, thereby producing hydrogenation and disproportionation reactions. Thereafter, the powder compacts were maintained at 860° C. for one more hour within an argon gas flow at a reduced pressure of 5.3 kPa to produce hydrogen desorption and recombination reactions. And then the temperature was decreased to room temperature within an Ar gas flow at the atmospheric pressure to obtain samples representing specific examples of the present invention. The present inventors confirmed that the fractured face of each of these samples obtained consisted of an aggregate structure of very small crystals and micropores that had similar appearance to that shown in the photograph of FIG. 1.

Next, the surface of the samples was worked with a surface grinder and the densities of the samples were calculated based on the dimensions and weight thereof after the grinding process. The results are shown in the following Table 11. The present inventors confirmed that each of these samples had sufficiently high mechanical strength because the magnet never cracked even after the grinding process. The samples that had been subjected to the grinding process were magnetized with a pulse magnetic field of 3.2 MA/m and then their magnetic properties were measured with a BH tracer MTR-1412 (produced by Metron, Inc.) The results are shown in the following Table 11. In Table 11, $J_{max}$ is the maximum value of magnetization J (T) of the magnetized sample when an external magnetic field H of up to 2 tesla (T) was applied to the sample in the magnetization direction and $H_k$ is a value of the external magnetic field H when $B_r \times 0.9$ as in the first specific example described above.

TABLE 11

| Alloy | Density (g/cm$^3$) | $B_r$ (T) | $H_{cJ}$ (kA/m) | $(BH)_{max}$ (kJ/m$^3$) | $B_r/J_{max}$ | $H_k/H_{cJ}$ |
|---|---|---|---|---|---|---|
| G | 6.21 | 0.93 | 795 | 156 | 0.96 | 0.57 |
| H | 6.11 | 0.96 | 890 | 169 | 0.97 | 0.55 |
| I | 6.24 | 0.98 | 971 | 180 | 0.97 | 0.59 |
| J | 6.05 | 1.02 | 887 | 196 | 0.98 | 0.65 |
| K | 6.01 | 0.99 | 850 | 179 | 0.98 | 0.62 |
| L | 5.96 | 1.02 | 883 | 193 | 0.97 | 0.61 |

Based on the results of this specific example, the present inventors confirmed that a porous magnet with good loop squareness, which is one of the effects of the present invention, could be obtained even if various elements were added to any of these R—Fe-Q alloy compositions.

Example #9

A rapidly solidified alloy M, of which the target composition is shown in the following Table 12, was made by a strip casting process. The rapidly solidified alloy thus obtained was coarsely pulverized, finely pulverized and then compacted under a magnetic field by the same methods as those already described for the first specific example, thereby obtaining a powder compact with a density of 4.20 g/cm$^3$. The mean particle size of the fine powder is also shown in the following Table 12 and was measured by the same method as that of the first specific example (with the 50% center particle size ($D_{50}$) regarded as the mean particle size).

TABLE 12

| Alloy | Target composition (at %) | $D_{50}$ of fine powder (μm) |
|---|---|---|
| M | $Nd_{15.90}Fe_{bal}Co_1B_{6.2}Ga_{0.1}Al_{0.5}Cu_{0.1}$ | 4.31 |

Next, the powder compact was subjected to the HDDR process described above. Specifically, the powder compact was heated to 880° C. within an argon gas flow at 100 kPa (that is the atmospheric pressure). After the atmospheres were changed into a hydrogen gas flow at 100 kPa (that is the atmospheric pressure), the powder compact was maintained at 880° C. for 30 minutes, thereby producing hydrogenation and disproportionation reactions. Thereafter, the powder compact was maintained at 880° C. for one more hour within an argon gas flow at a reduced pressure of 5.3 kPa to produce hydrogen desorption and recombination reactions. And then the temperature was decreased to room temperature within an Ar gas flow at the atmospheric pressure to obtain samples representing a specific example of the present invention. The present inventors confirmed that the fractured face of this sample consisted of an aggregate structure of very small crystals and micropores that had similar appearance to that shown in the photograph of FIG. 1.

Next, the surface of the sample was worked with a surface grinder and the density of the sample was calculated based on the dimensions and weight thereof after the grinding process. The results are shown in the following Table 13. The present inventors confirmed that this sample had sufficiently high mechanical strength because the magnet never cracked even after the grinding process. The sample that had been subjected to the grinding process was magnetized with a pulse magnetic field of 3.2 MA/m and then its magnetic properties were measured with a BH tracer MTR-1412 (produced by Metron, Inc.) The results are shown in the following Table 13. In Table 13, $J_{max}$ is the maximum value of magnetization J (T) of the magnetized sample when an external magnetic field H of up to 2 tesla (T) was applied to the sample in the magnetization direction and $H_k$ is a value of the external magnetic field H when $B_r \times 0.9$ as in the first specific example described above.

TABLE 13

| Alloy | Density (g/cm$^3$) | $B_r$ (T) | $H_{cJ}$ (kA/m) | $(BH)_{max}$ (kJ/m$^3$) | $B_r/J_{max}$ | $H_k/H_{cJ}$ |
|---|---|---|---|---|---|---|
| G | 6.59 | 1.10 | 970 | 227 | 0.98 | 0.67 |

Based on the results of this specific example, the present inventors confirmed that a porous bulk magnet having not only good loop squareness but also high $(BH)_{max}$, which could not be achieved by a bonded magnet made of a conventional HDDR magnetic powder, can be obtained by appropriately determining the composition, the additives, and manufacturing process conditions.

Example #10

Rapidly solidified alloys N through Q, of which the target compositions are shown in the following Table 14, were made by a strip casting process. The rapidly solidified alloys thus obtained were coarsely pulverized, finely pulverized and then compacted under a magnetic field by the same methods as those already described for the first specific example, thereby obtaining powder compacts with a density of 4.20 g/cm$^3$. The mean particle sizes of the fine powders are also shown in the following Table 14 and were measured by the same method as that of the first specific example (with the 50% center particle size ($D_{50}$) regarded as the mean particle size).

TABLE 14

| Alloy | Target composition (at %) | $D_{50}$ of fine powder (μm) |
|---|---|---|
| N | $Nd_{13.65}Fe_{bal}Co_8B_{6.5}Ga_{0.5}$ | 4.12 |
| O | $Nd_{14.20}Fe_{bal}Co_8B_{6.5}Ga_{0.5}$ | 4.09 |
| P | $Nd_{15.00}Fe_{bal}Co_8B_{6.5}Ga_{0.5}$ | 4.29 |
| Q | $Nd_{15.90}Fe_{bal}Co_8B_{6.5}Ga_{0.5}$ | 4.31 |

Next, the powder compacts were subjected to the HDDR process described above. Specifically, the powder compacts were heated to 860° C. within an argon gas flow at 100 kPa (that is the atmospheric pressure). After the atmospheres were changed into a hydrogen gas flow at 100 kPa (that is the atmospheric pressure), the powder compacts were maintained at 860° C. for two hours, thereby producing hydrogenation and disproportionation reactions. Thereafter, the powder compacts were maintained at 860° C. for one more hour within an argon gas flow at a reduced pressure of 5.3 kPa to produce hydrogen desorption and recombination reactions. And then the temperature was decreased to room temperature within an Ar gas flow at the atmospheric pressure to obtain samples representing specific examples of the present invention. The present inventors confirmed that the fractured face of each of these samples obtained consisted of an aggregate structure of very small crystals and micropores that had similar appearance to that shown in the photograph of FIG. 1.

Next, the surface of the samples was worked with a surface grinder and then the composition of each of these samples machined was analyzed with an ICP emission spectroscopy analyzer ICPV-1017 (produced by Shimadzu Corporation), the oxygen concentration thereof was measured with a gas analyzer EGMA-620W (produced by Horiba, Ltd.) and the content of the extra rare-earth element R' was calculated based on those values. The results are shown in the following Table 15. It should be noted that the content of the extra rare-earth element was calculated on the supposition that the impurities other than those shown in Table 15 were all included in Fe:

TABLE 15

| | Sintered body composition (wt %) | | | | | | Oxygen (O) concentration | Content of extra rare-earth element |
|---|---|---|---|---|---|---|---|---|
| Alloy | Nd | Pr | Fe | Co | B | Ga | (wt %) | R' (at %) |
| N | 29.4 | 0.12 | Balance | 7.15 | 1.04 | 0.51 | 0.55 | 0.53 |
| O | 30.3 | 0.11 | Balance | 7.12 | 1.03 | 0.50 | 0.54 | 1.09 |
| P | 31.6 | 0.03 | Balance | 6.82 | 1.05 | 0.50 | 0.65 | 1.62 |
| Q | 33.0 | 0.03 | Balance | 6.78 | 1.05 | 0.50 | 0.60 | 2.56 |

Next, the densities of the samples were calculated based on the dimensions and weight thereof after the grinding process. The results are shown in the following Table 16. The present inventors confirmed that each of these samples had sufficiently high mechanical strength because the magnet never cracked even after the grinding process. The samples that had been subjected to the grinding process were magnetized with a pulse magnetic field of 3.2 MA/m and then their magnetic properties were measured with a BH tracer MTR-1412 (produced by Metron, Inc.) The results are shown in the following Table 16. In Table 16, $J_{max}$ is the maximum value of magnetization J (T) of the magnetized sample when an external magnetic field H of up to 2 tesla (T) was applied to the sample in the magnetization direction and $H_k$ is a value of the external magnetic field H when $B_r \times 0.9$ as in the first specific example described above.

TABLE 16

| Alloy | Density (g/cm$^3$) | $B_r$ (T) | $H_{cJ}$ (kA/m) | $(BH)_{max}$ (kJ/m$^3$) | $B_r/J_{max}$ | $H_k/H_{cJ}$ |
|---|---|---|---|---|---|---|
| N | 5.38 | 0.91 | 725 | 156 | 0.97 | 0.75 |
| O | 5.55 | 0.90 | 950 | 154 | 0.98 | 0.75 |
| P | 6.03 | 0.94 | 1,002 | 168 | 0.97 | 0.74 |
| Q | 6.39 | 0.97 | 1,038 | 177 | 0.97 | 0.74 |

Based on the results of this specific example, the present inventors confirmed that a porous magnet with good loop squareness, which is one of the effects of the present invention, could be obtained, no matter which of these compositions with various R mole fractions was adopted. We also confirmed that relatively high coercivity $H_{cJ}$ was achieved by setting the content of the extra rare-earth element R' to be equal to or greater than 1 at %.

Example #11

Alloys O and R, of which the target compositions are shown in the following Table 17, were made. It should be noted that the alloy O is the same as the alloy O shown in Table 15. On the other hand, the alloy R was obtained by melting an alloy with the same target composition as the alloy N by an induction heating process, casting the alloy in a water-cooled die to make an ingot, and then subjecting the ingot to a homogenizing heat treatment at 1,000° C. for eight hours within an Ar atmosphere. Both of these alloys were coarsely pulverized, finely pulverized and then compacted under a magnetic field by the same methods as those already described for the first specific example, thereby obtaining powder compacts with densities of 4.18 g/cm$^3$ to 4.20 g/cm$^3$. The mean particle sizes of the fine powders are also shown in the following Table 17 and were measured by the same method as that of the first specific example (with the 50% center particle size ($D_{50}$) regarded as the mean particle size).

TABLE 17

| Alloy | Target composition (at %) | Material alloy was made by | $D_{50}$ of fine powder (μm) |
|---|---|---|---|
| O | $Nd_{14.20}Fe_{bal}Co_8B_{6.5}Ga_{0.5}$ | Strip casting | 4.09 |
| R | $Nd_{14.20}Fe_{bal}Co_8B_{6.5}Ga_{0.5}$ | Ingot | 4.77 |

Next, the powder compacts were subjected to the HDDR process described above. Specifically, the powder compacts were heated to 860° C. within an argon gas flow at 100 kPa (that is the atmospheric pressure). After the atmospheres were changed into a hydrogen gas flow at 100 kPa (that is the atmospheric pressure), the powder compacts were maintained at 860° C. for two hours, thereby producing hydrogenation and disproportionation reactions. Thereafter, the powder compacts were maintained at 860° C. for one more hour within an argon gas flow at a reduced pressure of 5.3 kPa to produce hydrogen desorption and recombination reactions. And then the temperature was decreased to room temperature within an Ar gas flow at the atmospheric pressure to obtain samples representing specific examples of the present invention. The present inventors confirmed that the fractured face of each of these samples obtained consisted of an aggregate structure of very small crystals and micropores that had similar appearance to that shown in the photograph of FIG. 1.

Next, the surface of the samples was worked with a surface grinder and the densities of the samples were calculated based on the dimensions and weight thereof after the grinding process. The results are shown in the following Table 18. The present inventors confirmed that each of these samples had sufficiently high mechanical strength because the magnet never cracked even after the grinding process. The samples that had been subjected to the grinding process were magnetized with a pulse magnetic field of 3.2 MA/m and then their magnetic properties were measured with a BH tracer MTR-1412 (produced by Metron, Inc.) The results are shown in the following Table 18. In Table 18, $J_{max}$ is the maximum value of magnetization J (T) of the magnetized sample when an external magnetic field H of up to 2 tesla (T) was applied to the sample in the magnetization direction and $H_k$ is a value of the external magnetic field H when $B_r \times 0.9$ as in the first specific example described above.

TABLE 18

| Alloy | Density (g/cm$^3$) | $B_r$ (T) | $H_{cJ}$ (kA/m) | $(BH)_{max}$ (kJ/m$^3$) | $B_r/J_{max}$ | $H_k/H_{cJ}$ |
|---|---|---|---|---|---|---|
| O | 5.55 | 0.90 | 950 | 154 | 0.98 | 0.75 |
| R | 5.56 | 0.89 | 960 | 149 | 0.98 | 0.67 |

Based on the results of this specific example, the present inventors confirmed that a porous magnet with good loop squareness, which is one of the effects of the present invention, could be obtained, no matter which of various methods was adopted to make the material alloy. We also confirmed that a relatively high $H_k/H_{cJ}$ ratio was achieved by adopting a strip casting process that is a rapid cooling process that does not produce an α-Fe phase easily.

Example #12

An experiment to be described below was carried out on an alloy having the composition shown in the following Table 19. The alloy was coarsely pulverized and finely pulverized by the same methods as those already described for the first specific example. The mean particle size of the fine powder is also shown in the following Table 19 and was measured by the same method as that of the first specific example (with the 50% center particle size ($D_{50}$) regarded as the mean particle size).

TABLE 19

| Alloy | Target composition (at %) | $D_{50}$ of fine powder (μm) |
|---|---|---|
| S | $Nd_{15.90}Fe_{bal}Co_1B_{6.2}Ga_{0.1}Al_{0.5}$ | 4.31 |

Next, as shown in the following Table 20, the fine powder was compacted either under no magnetic field or with an aligning magnetic field applied to obtain a powder compact with a density of 4.19 g/cm$^3$. Then, the powder compact was subjected to various HDDR processes. Specifically, the powder compact was heated to 880° C. within any of the temperature increasing atmospheres shown in Table 20. After the atmospheres were changed into another one of the atmospheres shown in Table 20, the powder compact was maintained at 880° C. for 30 minutes, thereby producing hydrogenation and disproportionation reactions. Thereafter, the powder compact was maintained at 880° C. for one more hour within an argon gas flow at a reduced pressure of 5.3 kPa to produce hydrogen desorption and recombination reactions. And then the temperature was decreased to room temperature within an Ar gas flow at the atmospheric pressure to obtain samples representing specific examples of the present invention.

TABLE 20

| Alloy | Compacted with magnetic field? | Temperature increasing atmosphere | HD process atmosphere | Experiment No. |
|---|---|---|---|---|
| S | NO | $H_2$ (atmospheric pressure) | $H_2$ (atmospheric pressure) | S-1 |
| | YES | $H_2$ + Ar (2:1, atmospheric pressure) | $H_2$ + Ar (2:1, atmospheric pressure) | S-2 |
| | YES | Ar (atmospheric pressure) | $H_2$ (atmospheric pressure) | S-3 |
| | YES | Ar (atmospheric pressure) | $H_2$ + Ar (2:1, atmospheric pressure) | S-4 |
| | YES | Vacuum | $H_2$ (125 kPa (pressurized)) | S-5 |

The present inventors confirmed that the fractured face of each of these samples obtained consisted of an aggregate structure of very small crystals and micropores that had similar appearance to that shown in the photograph of FIG. 1.

Next, the surface of the samples was worked with a surface grinder and the densities of the samples were calculated based on the dimensions and weight thereof after the grinding process. The results are shown in the following Table 21. The present inventors confirmed that each of these samples had sufficiently high mechanical strength because the magnet never cracked even after the grinding process. The samples that had been subjected to the grinding process were magnetized with a pulse magnetic field of 3.2 MA/m and then their magnetic properties were measured with a BH tracer MTR-1412 (produced by Metron, Inc.) The results are shown in the following Table 21. In Table 21, $J_{max}$ is the maximum value of magnetization J (T) of the magnetized sample when an external magnetic field H of up to 2 tesla (T) was applied to the sample in the magnetization direction and $H_k$ is a value of the external magnetic field H when $B_r \times 0.9$ as in the first specific example described above.

TABLE 21

| Experiment No. | Density (g/cm$^3$) | $B_r$ (T) | $H_{cJ}$ (kA/m) | $(BH)_{max}$ (kJ/m$^3$) | $B_r/J_{max}$ | $H_k/H_{cJ}$ |
|---|---|---|---|---|---|---|
| S-1 | 6.82 | 0.75 | 985 | 83 | 0.85 | 0.35 |
| S-2 | 6.82 | 1.13 | 341 | 207 | 0.97 | 0.87 |
| S-3 | 6.71 | 1.07 | 1,007 | 213 | 0.97 | 0.61 |
| S-4 | 6.72 | 1.20 | 329 | 227 | 0.99 | 0.91 |
| S-5 | 6.69 | 1.00 | 985 | 193 | 0.96 | 0.55 |

Based on the results of this specific example, the present inventors confirmed that a porous magnet with the appearance of the present invention could be obtained by any of those various processing methods.

Example #13

First, the same porous material (magnet) as the porous magnet of the first specific example of the present invention described above was prepared. Next, the porous material was machined into the dimensions of 7 mm×7 mm×5 mm with an outer blade cutter and a grinding machine. As a result of this machining, the porous material never cracked or chipped. Subsequently, the porous material was ultrasonic cleaned and then immersed in a nanoparticle dispersed colloidal solution, in which surface-oxidized Fe nanoparticles with a mean particle size of about 7 nm were dispersed and of which the solvent was dodecane and the solid matter concentration was 1.5 vol %. The nanoparticle dispersed colloidal solution was put into a glass container, which was then loaded into a vacuum desiccator with the porous material immersed in the solution and put under a reduced pressure. During this process, the atmospheric gas pressure was adjusted to about 130 Pa.

Due to the reduced pressure, bubbles were produced in the porous material and in the nanoparticle dispersed colloidal solution. And when the bubbles were no longer produced, the pressure was once raised to the atmospheric pressure. Thereafter, the porous material was inserted into a vacuum dryer and then heated to 200° C. under an atmospheric gas pressure of about 130 Pa, thereby vaporizing the solvent and drying the material. In this manner, a sample of a composite bulk material according to the present invention was obtained.

Figure 12:
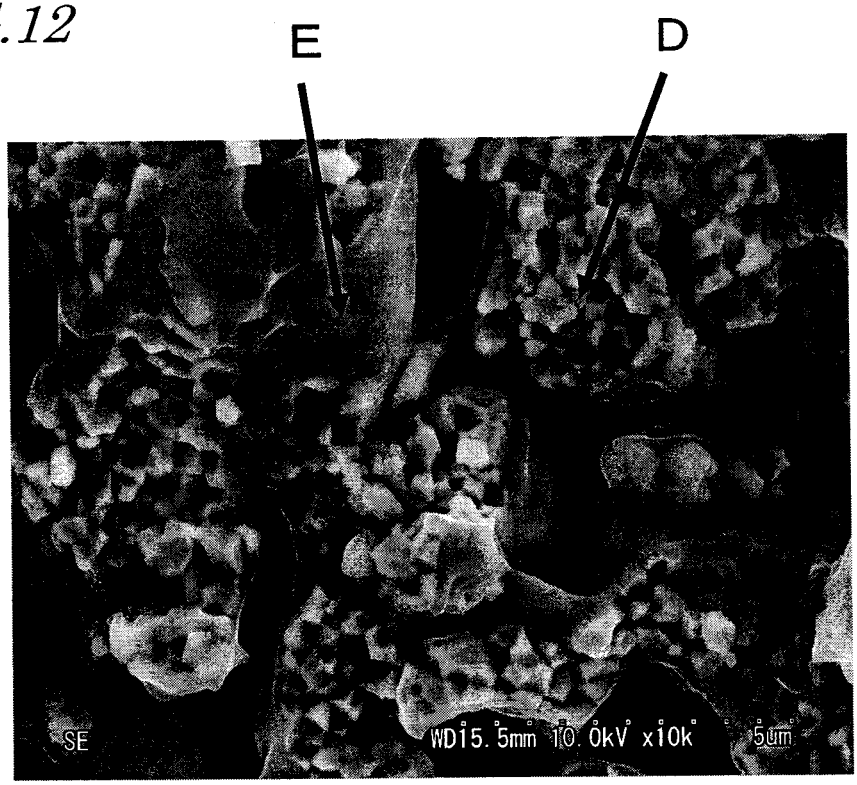
FIG. 12 is an SEM photograph showing a fractured face of a porous material that was prepared in a thirteenth specific example of the present invention.

A fractured surface of the sample thus obtained was observed with a scanning electron microscope (SEM). The result is shown in FIG. 12. As in FIG. 5, a fractured surface characterized by Region D (which is a fractured surface of a porous material) and Region E was observed. The intensities (contents) of element Fe in Regions D and E were compared to each other with an energy dispersed X-ray (EDX) analyzer. As a result, the intensity of Fe was higher in Region E than in Region D. Thus, it is believed that Fe nanoparticles that had been dispersed in a nanoparticle dispersed colloidal solution should have been transported along with the solvent through the micropores of the porous material and that the intensity should have been increased by fine particles that were left within the micropores even after the solvent was vaporized.

Based on these results, the present inventors confirmed that a composite bulk body of soft magnetic Fe nanoparticles, which would achieve high magnetization, and a porous magnet as a hard magnetic material could be made.

INDUSTRIAL APPLICABILITY

A porous magnet according to the present invention has better magnetic properties (superior loop squareness, among other things) than a bonded magnet and can be designed to have a more flexible shape than a conventional sintered magnet, and therefore, can be used effectively in various applications of conventional bonded magnets and sintered magnets.

The invention claimed is:

1. An R—Fe—B based porous magnet having an aggregate structure of $Nd_2Fe_{14}B$ type crystalline phases with an average grain size of 0.1 μm to 1 μm, at least a portion of the magnet being porous and having micropores with a major axis of 1 μm to 20 μm; wherein the magnet includes a structure in which a plurality of powder particles are bonded together without any resin and in which gaps between the plurality of powder particles define the micropores; and each of the plurality of powder particles includes the aggregate structure of the $Nd_2Fe_{14}B$ type crystalline phases; and easy magnetization axes of the $Nd_2Fe_{14}B$ type crystalline phases are aligned in a same direction.

2. The R—Fe—B based porous magnet of claim 1, wherein the powder particles have a mean particle size that is less than 10 μm.

3. The R—Fe—B based porous magnet of claim 1, wherein the micropores communicate with the air.

4. The R—Fe—B based porous magnet of claim 1, wherein the micropores are filled with no resin.

5. The R—Fe—B based porous magnet of claim 1, wherein the magnet has either radial anisotropy or polar anisotropy.

6. The R—Fe—B based porous magnet of claim 1, wherein the magnet has a density of 3.5 g/cm$^3$ to 7.0 g/cm$^3$.

7. The R—Fe—B based porous magnet of claim 1, wherein the magnet includes a rare-earth element, boron and/or carbon that satisfy 10 at %≤R≤30 at % and 3 at %≤Q≤15 at %, where R is the mole fraction of the rare-earth element and Q is the mole fraction of boron and carbon.

8. An R—Fe—B based magnet in which the density of the R—Fe—B based porous magnet of claim 1 has been increased to 95% or more of its true density.

9. The R—Fe—B based porous magnet of claim 8, wherein in the aggregate structure of the $Nd_2Fe_{14}B$ type crystalline phases, crystal grains with b/a ratios that are less than two account for at least 50 vol % of all crystal grains, where a and b are respectively the smallest and largest sizes of each of the crystal grains.

* * * * *